US007815188B2

(12) United States Patent
Nakashima

(10) Patent No.: US 7,815,188 B2
(45) Date of Patent: Oct. 19, 2010

(54) GAMING MACHINE

(75) Inventor: Shigeki Nakashima, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 1027 days.

(21) Appl. No.: 11/553,678

(22) Filed: Oct. 27, 2006

(65) Prior Publication Data

US 2007/0099693 A1 May 3, 2007

(30) Foreign Application Priority Data

Nov. 2, 2005 (JP) ..... 2005-319587

(51) Int. Cl.
*A63F 9/24* (2006.01)

(52) U.S. Cl. ..... 273/143 R; 463/22

(58) Field of Classification Search ..... 463/22; 273/142 A, 143 R

See application file for complete search history.

(56) References Cited

U.S. PATENT DOCUMENTS 2,969,610 A * 1/1961 Weiner ..... 446/341

FOREIGN PATENT DOCUMENTS

JP 2004-255019 9/2004

* cited by examiner

*Primary Examiner*—Corbett B Coburn
(74) *Attorney, Agent, or Firm*—Oblon, Spivak, McClelland, Maier & Neustadt, L.L.P.

(57) ABSTRACT

An object of the present invention is to provide a gaming machine that can provide more surprises and greater fun and increase interest in game playing while being distinct from other models by adding a wide variety of representation by moving devices to specific symbols presented on the reels.

The present invention provide a gaming machine that can provide more surprises and greater fun and increase interest in game playing while being distinct from other models by adding a wide variety of visual representations by moving device to part of symbols presented on the reels.

6 Claims, 37 Drawing Sheets

DISPLAY EXAMPLE (AT TIME OF START OPERATION)

FIG. 11

SYMBOL ARRANGEMENT TABLE

| LEFT REEL | | CENTER REEL | | RIGHT REEL | |
|---|---|---|---|---|---|
| SYMBOL POSITION | SYMBOL | SYMBOL POSITION | SYMBOL | SYMBOL POSITION | SYMBOL |
| 20 | Red cherry | 20 | Red cherry | 20 | Red cherry |
| 19 | Don-chan | 19 | Don-chan | 19 | Don-chan |
| 18 | Replay | 18 | Bell | 18 | Replay |
| 17 | Bell | 17 | Replay | 17 | Bell |
| 16 | Red 7 | 16 | BAR | 16 | Red 7 |
| 15 | BAR | 15 | Red 7 | 15 | BAR |
| 14 | Red 7 | 14 | BAR | 14 | Red 7 |
| 13 | Replay | 13 | Bell | 13 | Replay |
| 12 | Bell | 12 | Replay | 12 | Bell |
| 11 | BAR | 11 | BAR | 11 | BAR |
| 10 | Replay | 10 | Bell | 10 | Replay |
| 9 | BLUE CHERRY | 9 | BLUE CHERRY | 9 | BLUE CHERRY |
| 8 | Bell | 8 | Replay | 8 | Bell |
| 7 | BAR | 7 | BAR | 7 | BAR |
| 6 | Replay | 6 | Bell | 6 | Replay |
| 5 | BELL | 5 | Replay | 5 | Bell |
| 4 | Red 7 | 4 | Red 7 | 4 | Red 7 |
| 3 | Red 7 | 3 | Red 7 | 3 | Red 7 |
| 2 | Red 7 | 2 | Red 7 | 2 | Red 7 |
| 1 | Replay | 1 | Bell | 1 | Replay |
| 0 | Bell | 0 | Replay | 0 | Bell |

FIG. 12

SYMBOL COMBINATION TABLE

| LEFT REEL | CENTER REEL | RIGHT REEL | SYMBOL COMBINATION | NUMBER OF PAYOUT MEDALS | |
|---|---|---|---|---|---|
| | | | | NUMBER OF INPUT MEDALS:1 | NUMBER OF INPUT MEDALS:3 |
| Red cherry | ANY | ANY | Red cherry | 15 | 3 |
| Blue cherry | ANY | ANY | Blue cherry | 15 | 3 |
| Bell | Bell | Bell | Bell | 15 | 12 |
| Red 7 | Bell | Bell | Red 7 Bell | 12 | 1 |
| BAR | Bell | Bell | BAR Bell | 12 | 1 |
| Don-chan | Bell | Bell | Don-chan Bell | 12 | 1 |
| Replay | Replay | Replay | Replay | 0 | 0 |
| Red 7 | Red 7 | Red 7 | MB1 | 0 | 0 |
| BAR | BAR | BAR | MB2 | 0 | 0 |

FIG. 13

INTERNAL LOTTERY TABLE DETERMINATION TABLE

| GAMING MODE | TYPE | NUMBER OF TIMES OF LOTTERY |
|---|---|---|
| BASE GAMING MODE | FOR BASE GAMING MODE | 9 |
| CB GAMING MODE | | 6 |

FIG. 14

INTERNAL LOTTERY TABLE FOR BASE GAMING MODE
(RANDOM NUMBER RANGE: 0 – 65535)

| WINNING NUMBER | NUMBER OF INPUT MEDALS: 1 | | NUMBER OF INPUT MEDALS: 3 | |
|---|---|---|---|---|
| | LOWER LIMIT | UPPER LIMIT | LOWER LIMIT | UPPER LIMIT |
| 1 | 14 | 17 | 807 | 1066 |
| 2 | 0 | 3 | 0 | 259 |
| 3 | 18 | 2417 | 1067 | 8366 |
| 4 | 4 | 4 | 260 | 263 |
| 5 | 5 | 5 | 264 | 267 |
| 6 | 13 | 13 | 803 | 806 |
| 7 | 2418 | 11397(※1) | 8009 | 16988(※2) |
| 8 | 3 | 8 | 171 | 522 |
| 9 | 9 | 14 | 544 | 895 |

(*1: "32217" IF RT GAME NUMBER COUNTER IS EQUAL TO OR GREATER THAN 1)

(*2: "37808" IF RT GAME NUMBER COUNTER IS EQUAL TO OR GREATER THAN 1)

FIG. 15

INTERNAL WINNING COMBINATION DETERMINATION TABLE

| WINNING NUMBER | BASE GAMING MODE | | | CB GAMING MODE | | |
|---|---|---|---|---|---|---|
| | INTERNAL WINNING COMBINATION1 | INTERNAL WINNING COMBINATION2 | CONTENT | INTERNAL WINNING COMBINATION1 | INTERNAL WINNING COMBINATION2 | CONTENT |
| 0 | 00000000 | 00000000 | BLANK | 00000000 | 00011111 | COMBINED COMBINATION |
| 1 | 00000000 | 00000001 | Red charry | 00000000 | 00011111 | |
| 2 | 00000000 | 00000010 | Blue cherry | 00000000 | 00011111 | |
| 3 | 00000000 | 00000100 | Bell | 00000000 | 00011111 | |
| 4 | 00000000 | 00001000 | Red 7 Bell | 00000000 | 00011111 | |
| 5 | 00000000 | 00010000 | BAR Bell | 00000000 | 00011111 | |
| 6 | 00000000 | 00100000 | Don-chan Bell | 00000000 | 00011111 | |
| 7 | 00000001 | 00000000 | Replay | | | |
| 8 | 00000010 | 00000000 | MB1 | | | |
| 9 | 00000100 | 00000000 | MB2 | | | |

FIG. 16

REEL STOP INITIAL DETERMINATION TABLE

| STOP SELECT COUNTER | STOP TABLE |
|---|---|
| 0 (LOSS) | LOSS STOP TABLE |
| 1 (Red cherry) | Red cherry STOP TABLE |
| 2 (Blue cherry) | Blue cherry STOP TABLE |
| 3 (Bell) | Bell STOP TABLE |
| 4 (Red 7 BELL) | Red 7 Bell STOP TABLE |
| 5 (BAR Bell) | BAR Bell STOP TABLE |
| 6 (HAISAI Ball) | Don-chan Bell STOP TABLE |
| 7 (Replay) | Replay STOP TABLE |
| 8 (MB1) | MB 1 STOP TABLE |
| 9 (MB2) | MB 2 STOP TABLE |

FIG. 17

DRAW-IN PRIORITY TABLE

| PRIORITY | CONTENT |
|---|---|
| 1 | Replay |
| 2 | MB1,MB2 |
| 3 | Red cherry, Blue cherry, Bell |
| 4 | Red 7 Bell, BAR Bell, Don-chan Bell |

FIG. 18

BONUS OPERATION TIME TABLE

| STORAGE AREA | OPERATION TIME |
|---|---|
| | MB |
| OPERATING FLAG | MB OPERATING FLAG |
| BONUS END NUMBER COUNTER | 250 |

FIG. 19

(1) INTERNAL WINNING COMBINATION 1 STORAGE AREA

| CONTENT | | DATA |
|---|---|---|
| BIT7 | — | 0 |
| BIT6 | — | 0 |
| BIT5 | — | 0 |
| BIT4 | — | 0 |
| BIT3 | — | 0 |
| BIT2 | MB2 | 0~1 |
| BIT1 | MB1 | 0~1 |
| BIT0 | Replay | 0~1 |

(2) INTERNAL WINNING COMBINATION 2 STORAGE AREA

| CONTENT | | DATA |
|---|---|---|
| BIT7 | — | 0 |
| BIT6 | — | 0 |
| BIT5 | Don-chan Bell | 0~1 |
| BIT4 | BAR Bell | 0~1 |
| BIT3 | Red 7 Bell | 0~1 |
| BIT2 | Bell | 0~1 |
| BIT1 | Blue cherry | 0~1 |
| BIT0 | Red cherry | 0~1 |

(3) CARRYOVER COMBINATION STORAGE AREA

| CONTENT | | DATA |
|---|---|---|
| BIT7 | — | 0 |
| BIT6 | — | 0 |
| BIT5 | — | 0 |
| BIT4 | — | 0 |
| BIT3 | — | 0 |
| BIT2 | MB2 | 0~1 |
| BIT1 | MB1 | 0~1 |
| BIT0 | — | 0 |

(4) RANDOM NUMBER VALUE STORAGE AREA

| CONTENT | DATA |
|---|---|
| RANDOM NUMBER VALUE | 0~65535 |

(BONUS OPERATION MONITORING PROCESSING)

FIG. 23 (BONUS OPERATION MONITORING PROCESSING)

(REEL STOP CONTROL PROCESSING)

(INTERRUPT PROCESSING BY MAIN CPU CONTROL (1.1173 MS))

(RESET INTERRUPT PROCESSING BY SUB-CPU)

GAMING MACHINE

This application is based on and claims the benefit of priority from Japanese Patent Application No. 2005-319587, filed on Nov. 2, 2005 the content of which are incorporated herein by reference.

BACKGROUND OF THE INVENTION

1. Field of the Invention

The present invention relates to a gaming machine. Particularly, the present invention relates to a gaming machine equipped with mechanical reels.

2. Related Art

A slot machine having stop buttons, for example, a so-called pachislot machine, which is a slot machine having stop buttons, has a variable display device constituted by arranging a plurality of mechanical reels showing a plurality of symbols in a front display window or an electric variable display device displaying symbols on reels in a screen. A control device causes each reel to rotate by driving these variable display devices according to a start operation of a player to provide a display that is variable and, after a certain time, causes rotation of each reel to sequentially stop automatically or according to a stop operation of the player. If the symbol of each reel that appears in the display window matches a symbol combination, an award is provided to the player by paying out game media such as coins and medals.

Currently dominant models have a plurality of types of winning modes. Particularly when a predetermined symbol combination occurs a combination is carried out wherein not only are coins paid out once, but also gaming mode better than base gaming mode are set for a predetermined period. Such combinations include one wherein the game can be played a predetermined number of times providing a relatively great award to the player (called "big bonus," abbreviated henceforth as "BB") and a combination wherein the game can be played a predetermined number of times providing a relatively small award to the player (called "regular bonus," abbreviated henceforth as "RB").

In currently dominant models, to realize winning in which a predetermined combination of symbols lines up along an active payline and have coins or medals paid out, a combination must be won (hereinafter referred to as "internal winning") through internal lottery process, and also the player is required to perform a stop operation in a timely fashion so as to stop reels in such a way as to display the internally won combination (hereinafter referred to as "internal symbol combination") on the active line. That is, even if an internally symbol combination occurs, if the player performs a stop operation with incorrect timing, the player cannot win the award. In other words, skills acquired by practicing the timing of a stop operation are required (a Technical intervention called "observation push" is heavily weighted) in mainstream gaming machines.

In such gaming machines, it is known that game representation is improved by having an image generated from image data displayed in a display screen using a liquid crystal display or the like in the front display window (see, for example, Patent Document 1). In this gaming machine, visual representation effects are improved to increase the interest of the player by using a liquid crystal display or the like and displaying images such as predetermined characters.

[Patent Document 1] Japanese Unexamined Patent Application Publication No. 2004-255019

While the gaming machine has improved visual representation by using a liquid crystal display or the like and controlling image data and the like by digital signals, the visual representation of such gaming machines is lacking in surprises because the representation of image data using a liquid crystal display or the like has been very common in recent years.

Also, regarding the reels in a gaming machine, the symbols presented on the reels show no special originality and merely line up regularly giving a similar impression for almost every gaming machine, reducing the player's fun.

The present invention has been developed in consideration of the above situation and an object thereof is to provide a gaming machine that can provide more surprises and greater fun and increase the interest in game playing while distinguishing itself from other models by adding a wide variety of representation by moving device to specific symbols presented on the reels.

SUMMARY OF THE INVENTION

The first aspect of the invention is the gaming machine comprising a plurality of reels rotatably provided with a plurality of types of symbols on a peripheral face; a plurality of three-dimensional members disposed inside the peripheral face of the reels, each of which is capable of appearing from the peripheral face of each reel; and a plurality of moving device, each of which makes the three-dimensional members freely appear from the peripheral face to an outside and disappear; wherein each of the symbols includes a plurality of planar symbols on the peripheral face of each reel and a plurality of three-dimensional symbols on a surface of each three-dimensional member, and the moving device cause the three-dimensional members to project from the peripheral face to the outside if the reels stop and the symbols displayed in a predetermined area include any of the three-dimensional symbols is provided.

The stopping of the reels includes, in addition to the case of being controlled to stop based on a stop operation by a player shown in an embodiment described later, for example, the case of being controlled to stop by a control device or the like of a gaming machine without relying on the stop button, that is, independent of a stop operation of a player.

The second aspect of the invention is the gaming machine described in the first aspect, characterized in that each of the reels comprises a plurality of light sources disposed inside each three-dimensional member.

Any light source is sufficient and, for example, an LED or a black light may be used. Also, a device that can change colors, luminance, or luminescent symbols, or a combination of them may also be used.

The third aspect of the invention is the gaming machine described in the first aspect, characterized in that each of the reels is connected to each three-dimensional member and comprises a plurality of slewing gears that cause each three-dimensional member to rotate around an axis in a direction perpendicular to the peripheral face. Three-dimensional symbols may also be formed by members that are independent of the reels.

The fourth aspect of the invention is the gaming machine described in the first aspect, wherein three reels arrange side by side and the gaming machine is a slot machine.

The fifth aspect of the invention is the gaming machine described in the first aspect, characterized in that each of the moving device is elastically connected to each three-dimensional member, symbol holes formed in shapes similar to symbols corresponding to the three-dimensional symbols and formed to allow the three-dimensional members to slide are provided on the peripheral face of the reels, and each three-dimensional member frequently appears in a direction perpendicular to the peripheral face from the symbol holes of the peripheral face by expansion and contraction of each moving device.

The sixth aspect of the invention is the gaming machine described in the first aspect, further comprising an image display device displaying images related to a game is provided in front of the reels.

According to the present invention, a gaming machine can be provided that can increase interest in game playing by providing more surprises and fun while being distinct from other models by adding a wide variety of visual representations to part of the symbols presented on the reels by moving device.

BRIEF DESCRIPTION OF THE DRAWINGS

FIG. 11 is a diagram showing a symbol arrangement table.

FIG. 12 is a diagram showing a symbol combination table.

FIG. 13 is a diagram showing an internal lottery table determination table.

FIG. 14 is a diagram showing an internal lottery table.

FIG. 15 is a diagram showing an internal symbol combination determination table.

FIG. 16 is a diagram showing a reel stop initial determination table.

FIG. 17 is a diagram showing a draw-in priority table.

FIG. 18 is a diagram showing a bonus operation time table.

FIG. 19 is a diagram showing various storage areas.

DETAILED DESCRIPTION OF THE INVENTION

Figure 1:
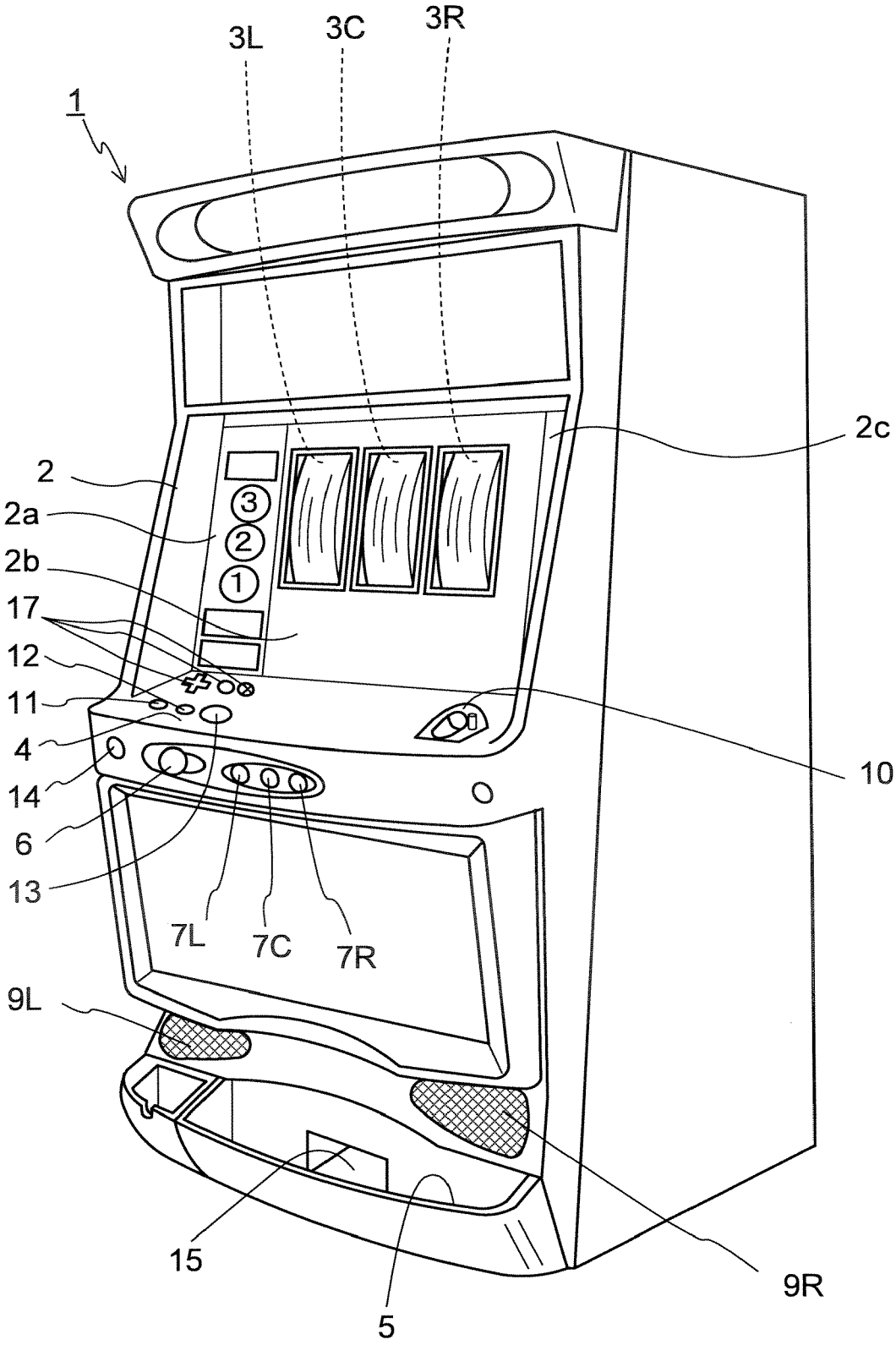
FIG. 1 is a perspective view showing the appearance of a gaming machine.

FIG. 1 is a perspective view showing the appearance of the gaming machine 1 according to an embodiment of the present invention. The gaming machine 1 is a so-called pachislot machine. This gaming machine 1 is a gaming machine played by using a game medium such as a card in which information about the play value granted or to be granted to a player is stored, in addition to coins, medals, playballs, and tokens, and a gaming machine played by using medals will be used for the descriptions below.

A panel display part 2*a*, a liquid crystal display part 2*b*, and a fixed display part 2*c* are formed as an approximately vertical surface in the front of a front door 2. To the rear of the front door 2, three reels 3L, 3C, and 3R are freely rotatably provided in a horizontal line. Each of the reels 3L, 3C, and 3R rotates at a constant speed (for example, 80 rotations/min).

Below the panel display part 2*a*, liquid crystal display part 2*b*, and fixed display part 2*c*, an approximately horizontal pedestal part 4 is formed. A medal input slot 10 into which medals are inserted is provided on the right side of the pedestal part 4. A medal inserted into the input port is credited or betted on a game. On the left side of the pedestal part 4, a 1-BET switch 11, a 2-BET switch 12, and a maximum BET switch 13 are provided for betting credited medals by pushing the switch.

One push operation of the 1-BET switch 11 bets one medal from among credited medals on a game, one push operation of the 2-BET switch 12 bets two medals from among credited medals on a game, and pushing the max BET switch 13 bets the max number of medals that can be betted in one game.

By operating these BET switches 11 to 13, a payline described later will be enabled. An operation of the BET switches 11 to 13 and an operation to insert medals (operation to insert medals to play a game) into the medal input slot 10 will be called a "BET operation" below. Above the BET switches 11 to 13, an operation part 17 is provided. The operation part 17 is operated to display information such as the play history in the liquid crystal display 131.

On the left front side of the pedestal part 4, a C/P switch 14 is provided so that a player can switch Credit/Payout of medals won in a game. By switching the C/P switch 14, medals are paid out from a medal delivery port 15 and paid-out medals are detained by a medal receiving part 5. On the left and right sides above the medal receiving part 5, speakers 9L and 9R are provided to produce sound effects for game representation.

At the right of the C/P switch 14, a start lever 6 for rotating the above reels by the player's operation and starting the variable display of symbols within the symbol display areas 21L, 21C, and 21R is provided freely rotatably within a predetermined range of angle.

In the front center of the pedestal part 4 and at the right of the start lever 6, three stop buttons 7L, 7C, and 7R to stop the rotation of the three reels 3L, 3C, and 3R respectively are provided. In the present embodiment, basically one game (unit play) starts by the operation of the start lever 6 and ends when all reels 3L, 3C, and 3R stop.

Here, in the present embodiment, a stop operation (operation of the stop button) when all reels are rotating is called a first stop operation, a stop operation performed after the first stop operation is called a second stop operation, and a stop operation performed after the second stop operation is called a third stop operation. On the rear sides of the respective stop button 7L, 7C, and 7R, stop switches 7LS, 7CS, and 7RS shown in FIG. 8 described later are arranged. These stop switches detect an operation (stop operation) of the corresponding stop button.

Figure 2:
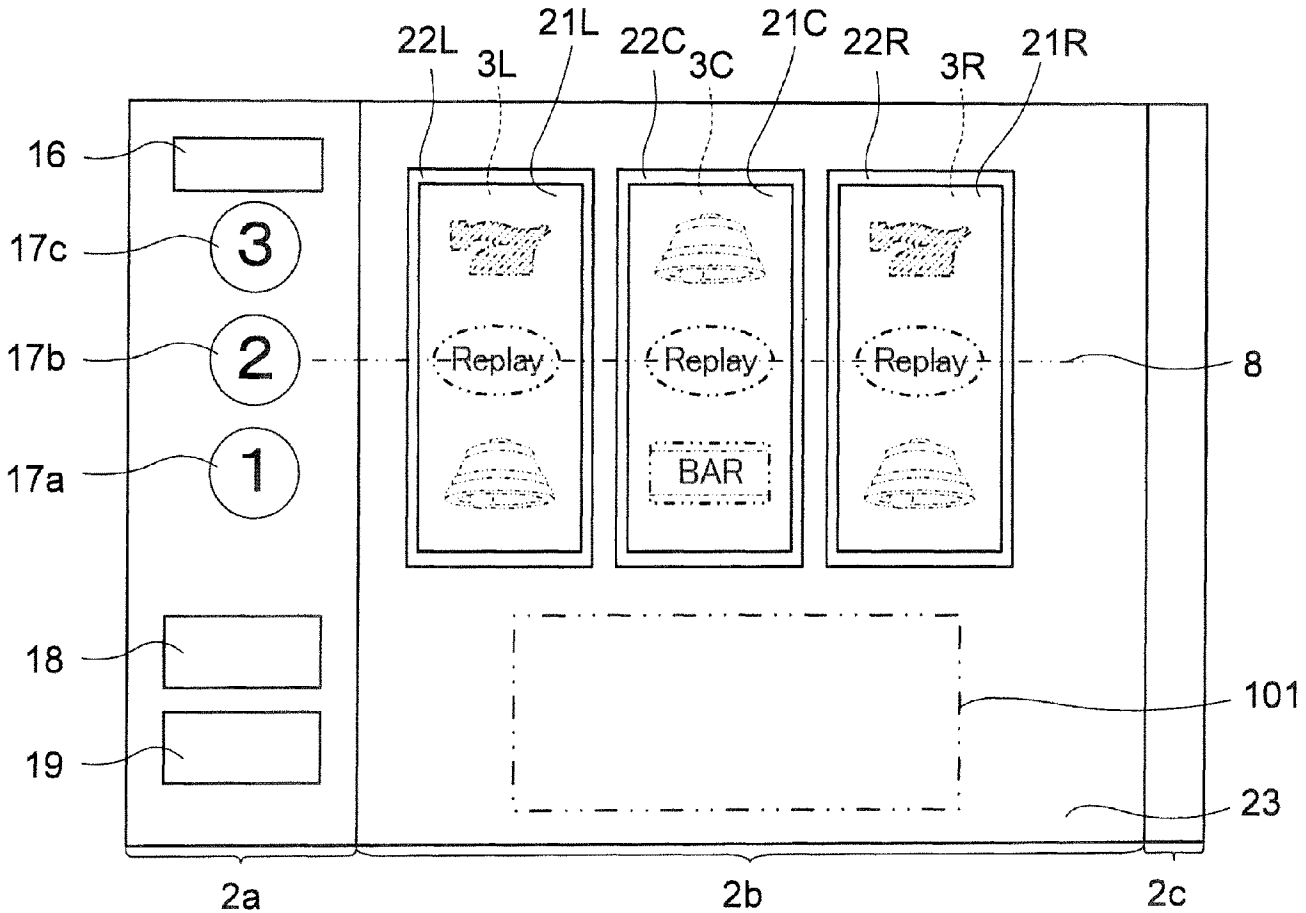
FIG. 2 is a diagram showing a panel display, a liquid crystal display part, and a fixed display of a liquid crystal display.

The panel display part 2*a*, liquid crystal display part 2*b*, and fixed display part 2*c* will be described with reference to FIG. 2. The panel display part 2*a* is comprised of a bonus game information display part 16, BET lamps 17*a* to 17*c*, a payout display part 18, and a credit display part 19. The bonus game information display part 16 is composed of a 7-segment LED and displays game information provided as a bonus. The 1-BET lamp 17*a*, 2-BET lamp 17*b*, and max BET lamp 17*c* are turned on according to the number of medals (hereinafter referred to as a "BET number") bet on one game.

The 1-BET lamp 17*a* is turned on when the BET number is one. The 2-BET lamp 17*b* is turned on when the BET number is two. The max BET lamp 17*c* is turned on when the BET number is three. The payout display part 18 and the credit display part 19 are each composed of a 7-segment LED and display the number of medals to be paid out when an award is won and the number of credited medals respectively.

The liquid crystal display part 2*b* includes the symbol display areas 21L, 21C, and 21R, window frame display areas 22L, 22C, and 22R, and a representation display area 23. The display contents of the liquid crystal display part 2*b* will change depending on the rotation and stop modes of the reels 3L, 3C, and 3R, and the operation of the liquid crystal display 131 described later (See FIG. 3 described later).

The symbol display areas 21L, 21C, and 21R are provided corresponding to each of reels 3L, 3C, and 3R and display symbols arranged on the reels 21L, 21C, and 21R and various kinds of representation.

A center line 8 is provided in the symbol display areas 21L, 21C, and 21R as a payline. This payline is enabled when a player performs the operation of pushing any of the BET switches 11 to 13 or inserting a medal into the medal input slot 10 (An enabled payline will be described as an "active line"). The active line is always enabled when the BET number is one or more regardless of the BET number.

Here, in each of the symbol display areas 21L, 21C, and 21R, three positions (upper, middle, lower) are provided as symbol stop positions respectively in a vertical direction. If variable displaying (moving display) of symbols in each of the symbol display areas 21L, 21C, and 21R stops, a symbol is stopped at each of the symbol stop positions provided in each of the symbol display areas 21L, 21C, and 21R then displayed. The payline links the symbol stop position in each of the symbol display areas 21L, 21C, and 21R.

The symbol display areas 21L, 21C, and 21R are in a transparent state at least while the corresponding reels 3L, 3C, and 3R are rotating or the corresponding stop buttons 7L, 7C, and 7R are ready for pushing down so that the player can visually recognize symbols on the reels 3L, 3C, and 3R.

The window frame display areas 22L, 22C, and 22R are provided to frame each of the symbol display areas 21L, 21C, and 21R and represent the window frames of the symbol display areas 21L, 21C, and 21R arranged in front of the reels 3L, 3C, and 3R.

The presentation display area 23 is an area excluding the symbol display areas 21L, 21C, and 21R and the window frame display areas 22L, 22C, and 22R from the liquid crystal display part 2*b*. The fixed display part 2*c* is an area in which predetermined figures and drawings are shown. Also, one static image or dynamic image may be made to be displayable by combining figures and drawings shown in the fixed display part 2*c* with images displayed in the presentation display area 23.

Figure 10:
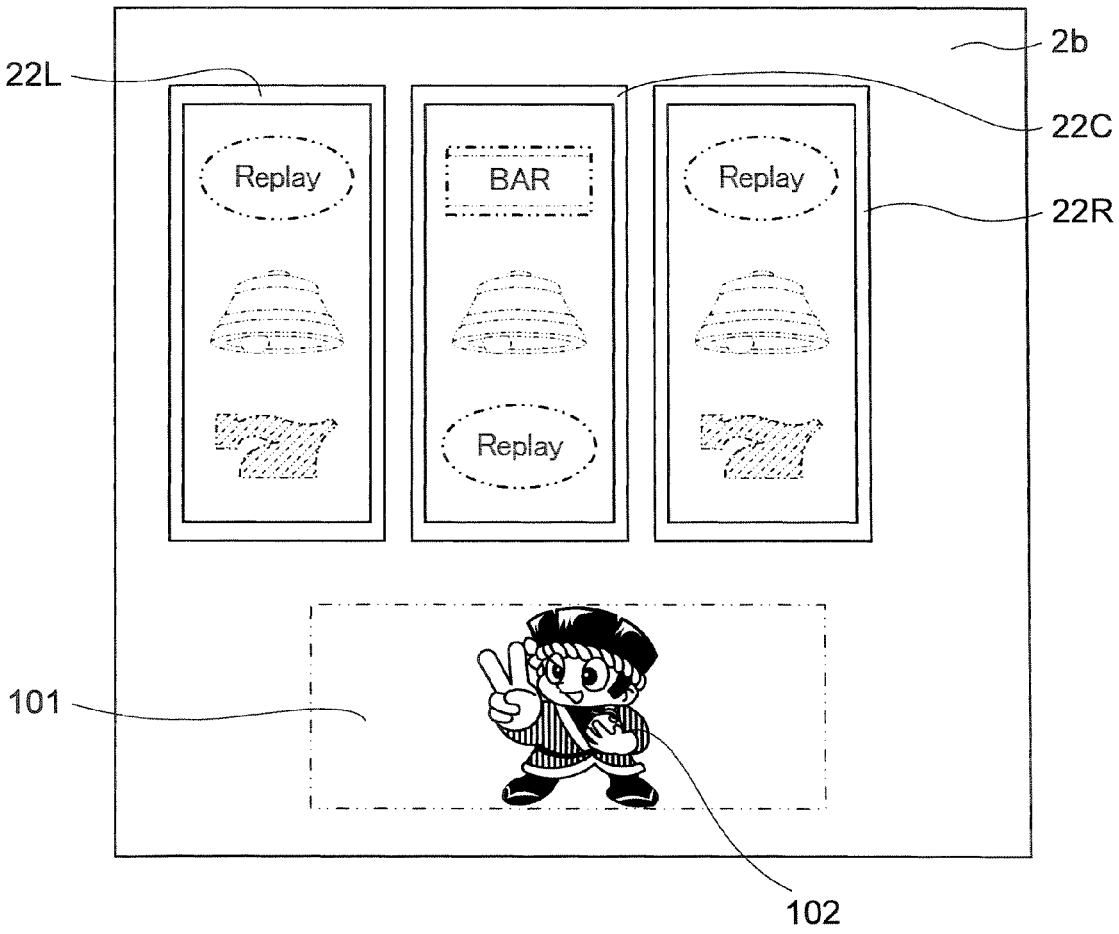
FIG. 10 is a diagram showing a display example of the liquid crystal display part.

The presentation display area 23 has an information area 101. The information area 101 is an area provided below the window frame display areas 22L, 22C, and 22R and is used, for example, when an image indicating internal winning of MB described later is signaled. The information area 101 looks, for example, as shown in FIG. 10 described later when a start operation is performed.

Figure 3:
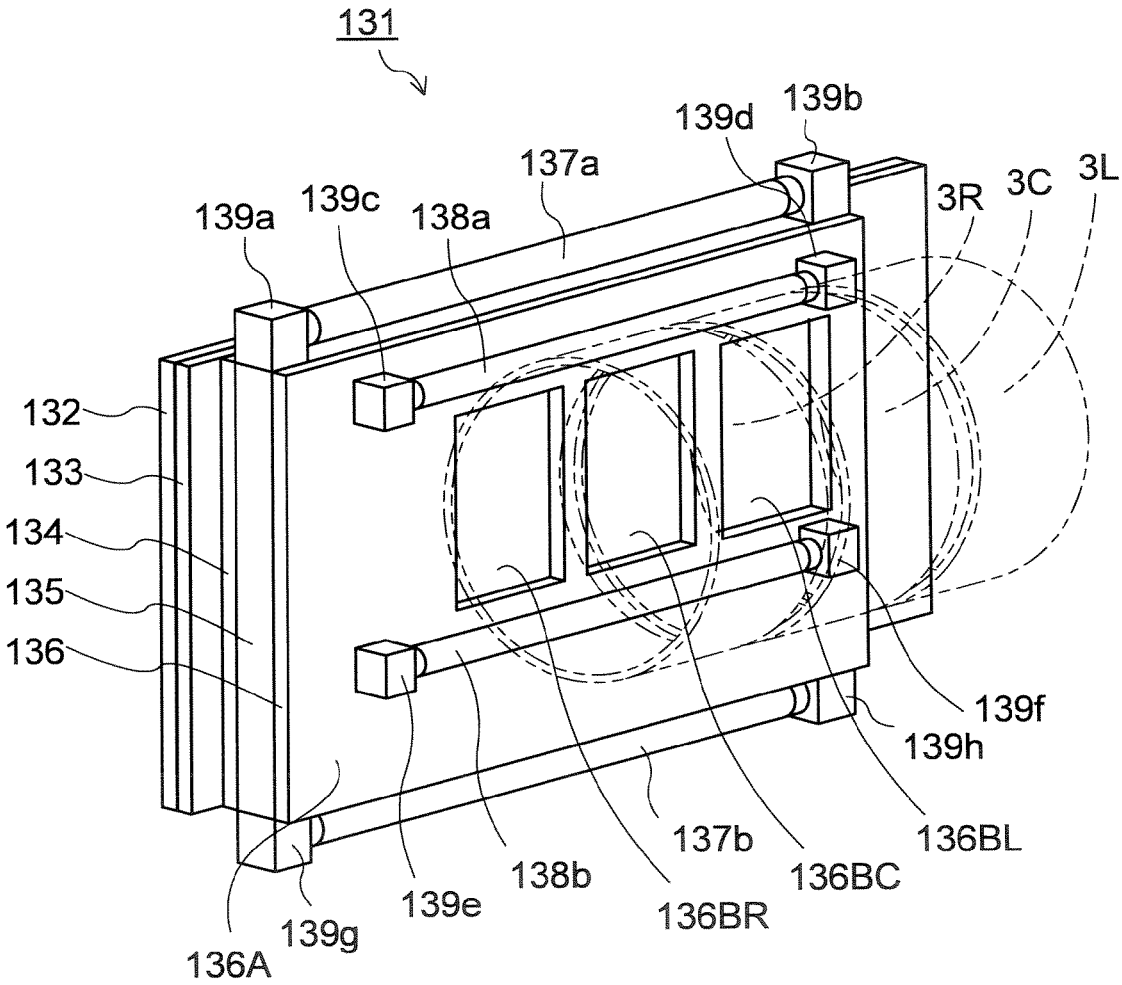
FIG. 3 is a perspective view showing an outline of the configuration of the liquid crystal display.

FIG. 3 is a perspective view showing an outline of the configuration of the liquid crystal display 131. The liquid crystal display 131 is comprised of a cover glass 132, a display board 133, a liquid crystal panel 134, a light guide plate 135, a reflection film 136, fluorescent lamps 137*a*, 137*b*, 138*a*, and 138*b*, which are white light sources (including, for example, light of all wavelengths so that no a specific color stands out does not jump to a person's eyes), lamp holders 139*a* to 139*h*, and a flexible board (not shown) composed of a table carrier package on which ICs for driving the liquid crystal panel are mounted and which is connected to a terminal area of the liquid crystal panel 134.

The liquid crystal display 131 is provided on the near side when viewed from the front of the display areas of the reels 3L, 3C, and 3R (that is, on the near side of the display surface). The reels 3L, 3C, and 3R and the liquid crystal display 131 are provided separately (for example, with a predetermined gap).

The cover glass 132 and the display board 133 are made of translucent members. The cover glass 132 is provided to protect the liquid crystal panel 134. Figures and drawings are drawn in areas of the display board 133 corresponding to the panel display part 2*a* and the fixed display part 2*c* (See FIG. 2).

In FIG. 3, illustrations of various display parts (such as the bonus game information display part 16, payout display part 18 and credit display part 19) arranged on the rear side of the area of the display board 133 corresponding to the panel display part 2*a* and electric circuits for operating the BET lamps 17*a* to 17*c* are omitted.

The liquid crystal panel 134 is formed by filling a liquid crystal in a gap part between a transparent board such as a glass plate on which a thin-film transistor layer is formed and an opposite transparent board. The display mode of the liquid crystal panel 134 is set to normally white. Normally white is a setup in which white is displayed when the liquid crystal is not driven (that is, when no voltage is applied to the liquid crystal panel 134). That is, sufficient light reaches the display surface side and thus transmitted light is visible from outside.

Thus, by adopting the liquid crystal panel 134 set up for normally white, symbols arranged on the reels 3L, 3C, and 3R can visually be recognized through the symbol display areas 21L, 21C, and 21R even if a situation occurs in which the liquid crystal cannot be driven, and therefore a game can be continued. That is, even if a situation occurs in which the liquid crystal cannot be driven, games including rotation of the reels 3L, 3C, and 3R and their stopping can still be played.

The light guide plate 135 is provided on the rear side of the liquid crystal panel 134 to lead light from the fluorescent lamps 137*a* and 137*b* into the liquid crystal panel 134 (illuminate the liquid crystal panel 134) and is made, for example, of translucent members (that is, members having a light guiding function) such as an acrylic resin having a thickness of about 2 cm.

The reflection film 136 is used by forming, for example, a silver evaporated film on a white polyester film or aluminum thin film, and causes light led into the light guide plate 135 to reflect toward the front side. This illuminates the liquid crystal panel 134. The reflection film 136 is comprised of a reflection area 136A and non-reflection areas (that is, transmission areas) 136BL, 136BC, and 136BR. The non-reflection areas 136BL, 136BC, and 136BR are formed by transparent material as light transmission areas to allow incident light to transmit without reflection.

The non-reflection areas 136BL, 136BC, and 136BR are provided at a front position of each symbol to be displayed when rotation of the reels 3L, 3C, and 3R stops. The sizes and positions of the non-reflection areas 136BL, 136BC, and 136BR are formed to match those of the symbol display areas 21L, 21C, and 21R (See FIG. 2). In the reflection film 136, other areas than the non-reflection areas 136BL, 136BC, and 136BR are the reflection area 136A and light led by the light guide plate 135 is caused to reflect toward the front side by the reflection area 136A.

The fluorescent lamps 137*a* and 137*b* are arranged along a top end and bottom end of the light guide plate 135 and both ends thereof are supported by the lamp holders 139*a*, 139*b*, 139*g*, and 139*h*. The fluorescent lamps 137*a* and 137*b* generate light to be led into the light guide plate 135.

The fluorescent lamps 138*a* and 138*b* are arranged above and below on the rear side of the reflection film 136. Light emitted from the fluorescent lamps 138*a* and 138*b* is reflected on the surface of the reels 3L, 3C, and 3R to enter the non-reflection areas 136BL, 136BC, and 136BR. Then, the incident light passes through the non-reflection areas 136BL, 136BC, and 136BR to illuminate the liquid crystal panel 134.

Additional functions of the fluorescent lamps 137*a*, 137*b*, 138*a*, and 138*b* will be described. First, a function of each lamp when the liquid crystal in the symbol display areas 21L, 21C, and 21R is not driven (that is, no voltage is applied to areas corresponding to the symbol display areas 21L, 21C, and 21R of the liquid crystal panel 134) will be described.

Part of light emitted from the fluorescent lamps 138*a* and 138*b* is reflected by a reel sheet 310. Since the light passes through the non-reflection areas 136BL, 136BC, and 136BR, and the light guide plate 135 and the liquid crystal panel 134 constituting the liquid crystal display 131, the player can visually recognize the symbols arranged on the reels.

Also, light emitted from the fluorescent lamps 137*a* and 137*b* and led toward the light guide plate 135 reaches the player's eyes after passing through the liquid crystal panel 134. That is, areas of the liquid crystal panel 134 corresponding to the window frame display areas 22L, 22C, and 22R, and the representation display area 23 are illuminated by the fluorescent lamps 137*a* and 137*b*.

Next, the function of each lamp when the liquid crystal in the symbol display areas 21L, 21C, and 21R is driven (that is, a voltage is applied to areas corresponding to the symbol display areas 21L, 21C, and 21R of the liquid crystal panel 134) will be described.

Part of light emitted from the fluorescent lamps 138*a* and 138*b* is reflected by the reel sheet 310. Since part of the light is reflected, absorbed, or transmitted by areas of the liquid crystal panel 134 where the liquid crystal is driven, the player can visually recognize representation symbols and the like displayed in the symbol display areas 21L, 21C, and 21R.

Figure 4:
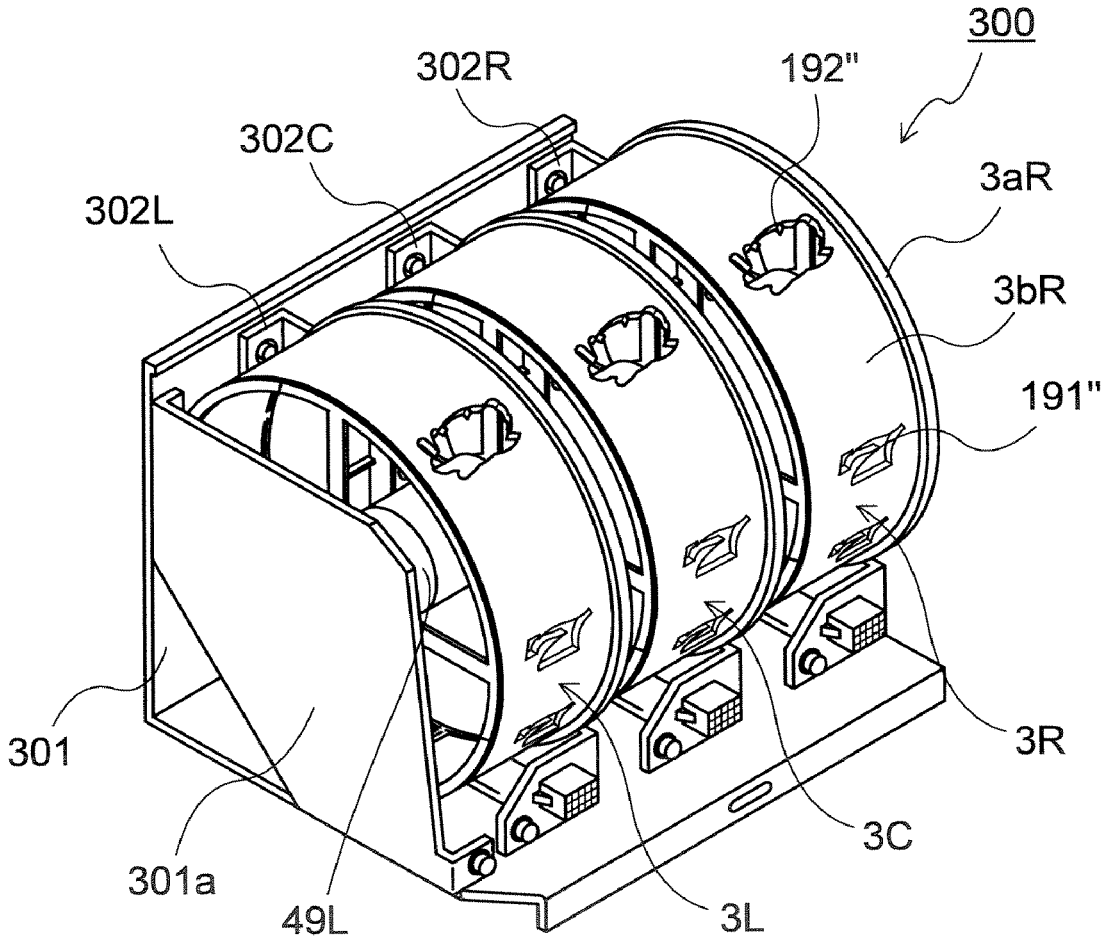
FIG. 4 is a schematic diagram showing an appearance of a reel unit.

FIG. 4 is a schematic diagram showing the appearance of a reel unit 300 having the reels 3L, 3C, and 3R. As shown in FIG. 4, the reels 3L, 3C, and 3R are freely rotatably provided in the reel unit 300. The reel unit 300 has an approximately L-shaped frame 301 and a side plate 301*a*. Brackets 302L, 302C, and 302R are provided in the approximately L-shaped frame 301. Stepping motors 49L, 49C, and 49R described later are held by the brackets 302L, 302C, and 302R. The reels 3L, 3C, and 3R are supported by the stepping motors 49L, 49C, and 49R. In FIG. 4, the reel sheet 310 (FIG. 7) on which symbols are presented, symbol members 191 and 192, and actuators 304L, 304C, and 304R are omitted.

Figure 5:
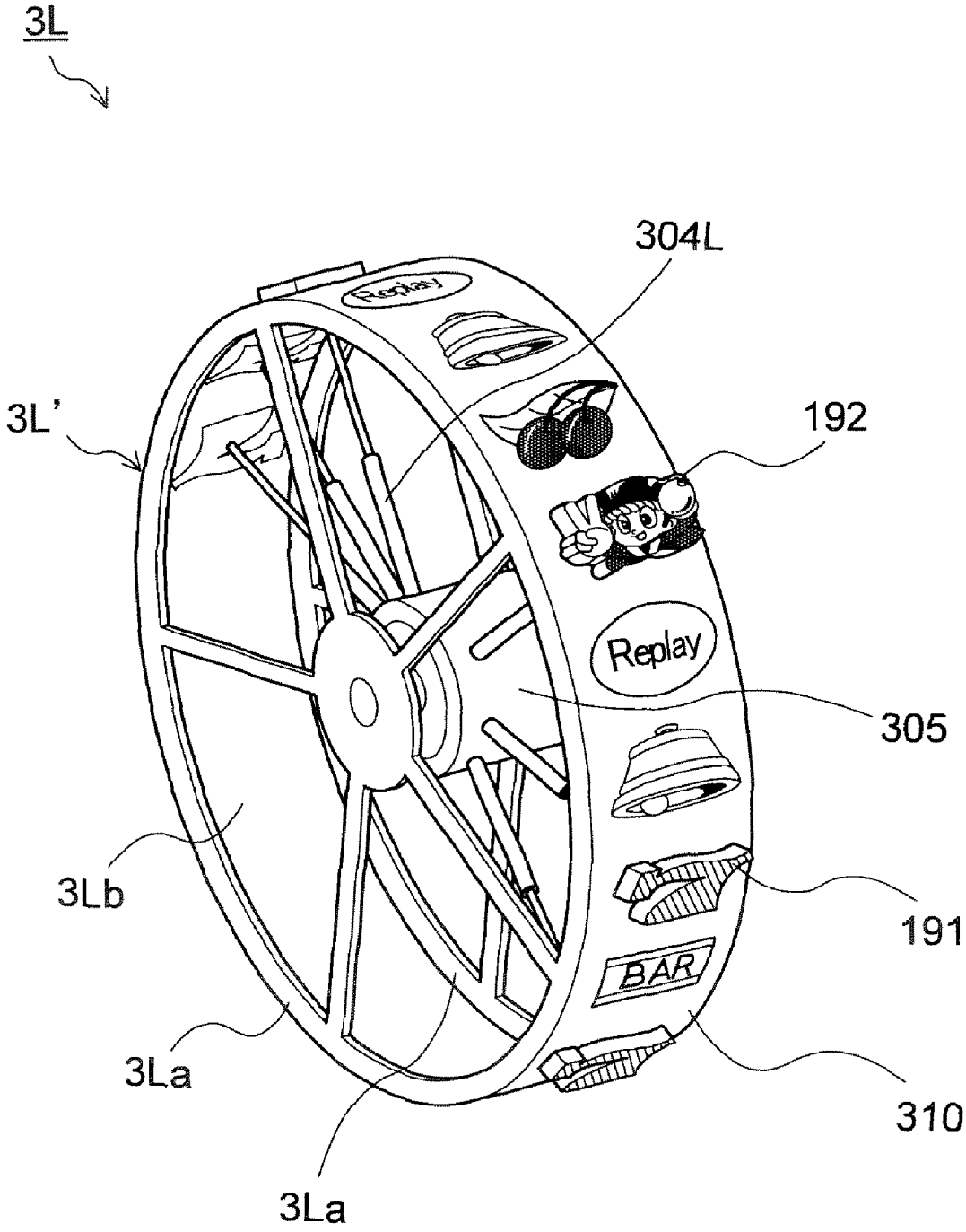
FIG. 5 is a perspective view showing the left reel.

FIG. 5 is a perspective view showing the left reel 3L of the reel unit 300 arranged on the left side viewed from the player.

As shown in FIG. 5, the left reel 3L has a cylindrical-shaped frame 3L' formed by connecting two circular frames 3La of the same shape using a plate-like connecting member 3Lb with both circular frames a predetermined distance (for example, a reel width) apart, a plurality of actuators 304L whose drive is controlled by a symbol member drive circuit 330 described later, the symbol members 191 and 192, each of which is driven to slide by each actuator 304L, and a cylindrical-shaped rotating member 305 provided in the center of the cylindrical-shaped frame 3L' to support the actuator 304L. The stepping motor 49L is provided in the hollow interior of the rotating member 305. The rotating member 305 is connected to the cylindrical-shaped frame 3L' and rotates together with the cylindrical-shaped frame 3L'.

The symbol members 191 and 192 are provided at an end in the lengthwise direction, of the actuator 304L. The symbol members 191 and 192 have a presentation surface on which symbols are presented and a three-dimensional part extending in a direction perpendicular to the presentation surface. The three-dimensional part sliding moves symbol holes 191', 192', 191", and 192" described later.

Figure 6A:
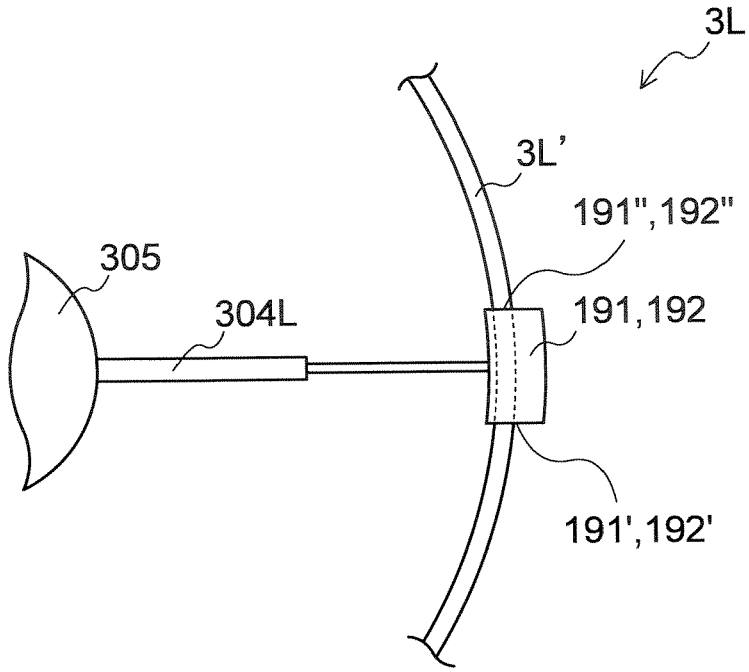
FIG. 6A is a partial schematic diagram showing states in which symbol members are driven to slide.
Figure 7:
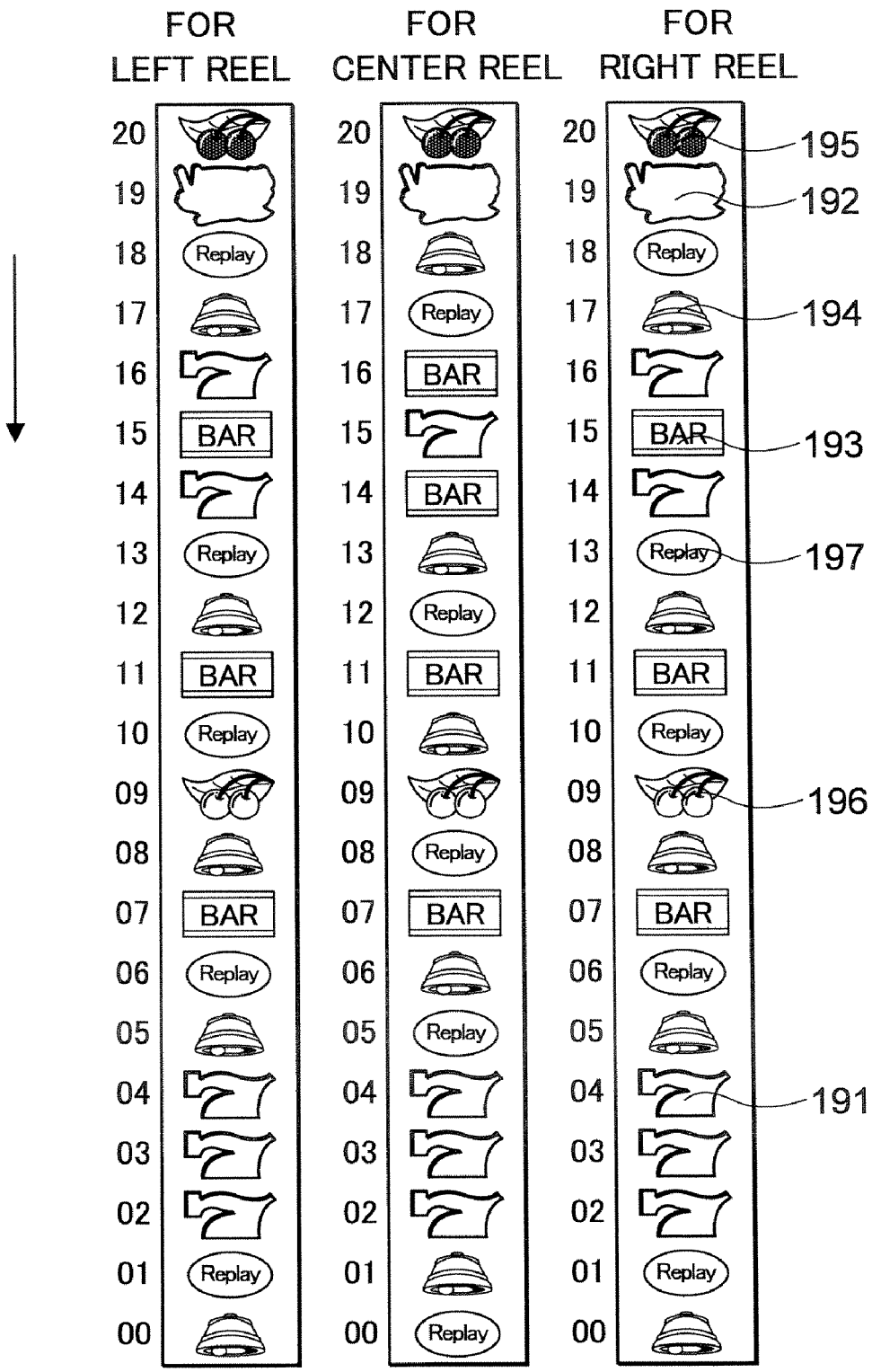
FIG. 7 is a diagram illustrating symbols arranged on reels.

The connecting member 3Lb is furnished with the reel sheet 310 described later (FIG. 7). On the reel sheet 310, a plurality of types of symbols 193, 194, 195, 196, and 197 are arranged. At positions where the symbol members 191 and 192 are arranged, symbol holes 191' and 192' (FIG. 6A) obtained by hollowing out symbol outlines of the symbol members 191 and 192 are provided. The connecting member 3Lb also has the symbol holes 191" and 192" provided for sliding the symbol members 191 and 192 respectively. The symbol members 191 and 192 slide through the symbol holes 191' and 192' and the symbol holes 191" and 192" by expansion and contraction of the actuator 304L (FIG. 6A).

FIG. 6A shows states in which the symbol members 191 and 192 are driven to slide by expansion and contraction of the actuator 304L.

Figure 6B:
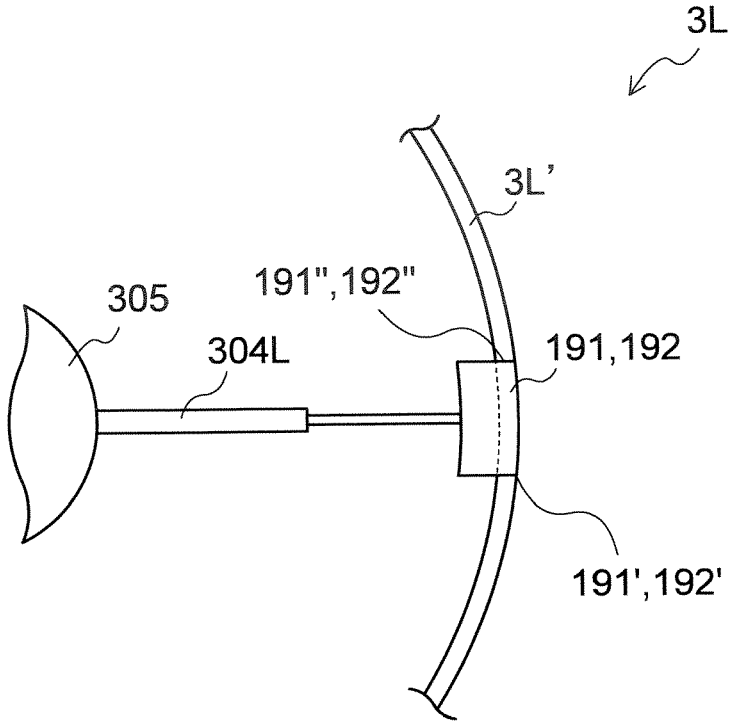
FIG. 6B is a partial schematic diagram showing the normal states.

FIG. 6B is a schematic diagram showing the normal state, that is, the so-called reel 3L rotating state or the state not related to a symbol combination described later. As shown in FIG. 6B, the actuator 304L normally is not driven to expand or contract and the presentation surface of symbols of the symbol members 191 and 192 has a planar appearance on the surface of the reel L3 similarly to other planar symbols of the reel sheet 310. On the other hand, if the reel 3L stops, as shown in FIG. 6A, the actuator 304L is expanded by the symbol member drive circuit 330 controlled by a CPU 31 described later so that the symbol members 191 and 192 project from the surface of the reel 3L.

Though not used in the present embodiment, the symbol members 191 and 192 may be constituted using transparent members with luminescent devices such as an LED inside. Also, a luminous configuration may be adopted by arranging luminescent devices such as an LED along the outside edges of the symbols. This will increase the visibility of the player.

FIG. 7 shows symbol sequences presented on each of the reels 3L, 3C, and 3R in which 21 multiple symbols are arranged. Each symbol is code-numbered from "00" to "20" and stored in ROM 32 (FIG. 8) as a data table described later. On each of the reels 3L, 3C, and 3R, a symbol sequence composed of symbols "Red 7", "Don-chan", "BAR (symbol 193)", "Bell (symbol 194)", "Red cherry (symbol 195)", "Blue cherry (symbol 196)", and "Replay (symbol 197)" is presented. Each of the reels 3L, 3C, and 3R is driven to rotate so that each symbol sequence moves in the direction of the arrow in FIG. 7.

In the present embodiment, "Red 7" and "Don-chan" are selected as three-dimensional symbols, but the present invention is not limited to this and other symbols may also adopt three-dimensional symbols.

On each of the reels 3L, 3C, and 3R, "Red 7" and "BAR", which constitute a symbol combination of MB (continuous actuator related to a second-type special accessory) are in some places arranged at intervals of symbols exceeding the maximum number of sliding pieces (4 in the present embodiment). For example, "Red 7" of the code number 04 and "Red 7" of the code number 14 are arranged at intervals of nine symbols.

Here, as combinations in the present embodiment, MB1, MB2, Red cherry, Blue cherry, Bell, Red 7 bell, BAR bell, Don-chan bell, Combined combination, and Replay are provided. MB1 and MB2 are collectively called "Middle bonus (MB)." Red cherry, Blue cherry, Bell, Red 7 bell, BAR bell, and Don-chan bell are collectively called "Minor combination."

A combination (combination data) is basically control information in which correspondences between awards to be granted to the player and symbol combinations are established in advance, and is used for stop control of the reels 3L, 3C, and 3R, switching (transition) of gaming mode, and granting of play value. A combined combination has a plurality of correspondences (a set of a plurality of combinations) between awards to be granted to the player and the symbol combinations. A symbol combination to be presented is determined by the timing of the operation of the stop buttons 7L, 7C, and 7R.

The gaming mode in the present embodiment is basically either the base gaming mode or challenge bonus gaming mode (abbreviated as "CB gaming mode" below). The gaming mode can basically be distinguished by the type of internal lottery table used for determining the internal lottery combination and the mode of reel stop control (such as the maximum number of the so-called "number of sliding pieces"). More specifically, the gaming mode can be distinguished by the type of combination likely to achieve internal winning, in a probability of internal winning, the maximum number of sliding pieces and the like. After the left stop button 7L is operated, the left reel 3L in the CB gaming mode stops within a first time (for example, 75 ms). Otherwise, the left reel 3L stops within a second time (for example, 190 ms). That is, a plurality of types of gaming mode with different max times until the reels 3L, 3C, and 3R stop after the stop buttons 7L, 7C, and 7R are operated are provided.

The base gaming mode is composed of a normal interval without carryover, a replay time interval (abbreviated as a "RT interval" below) in which internal winning of a replay is more probable than the normal interval, and a carryover interval with a carryover combination. No internal winning of MB occurs in the carryover interval, and internal winning of the MB may occur in the normal interval and RT interval. Internal winning of a replay is more probable in the RT interval than the normal interval and carryover interval.

Thus, the normal interval, RT interval, and carryover interval basically represent mutually different gaming modes. A carryover combination is a combination in which a corresponding combination of symbols is permitted (permitted according to the internal symbol combination) to line up along the active line in one game or a plurality of games. The carryover combination is contained in the internal symbol combination. A playing interval of the base gaming mode other than the RT interval will be called "non-RT interval" below.

Figure 20:
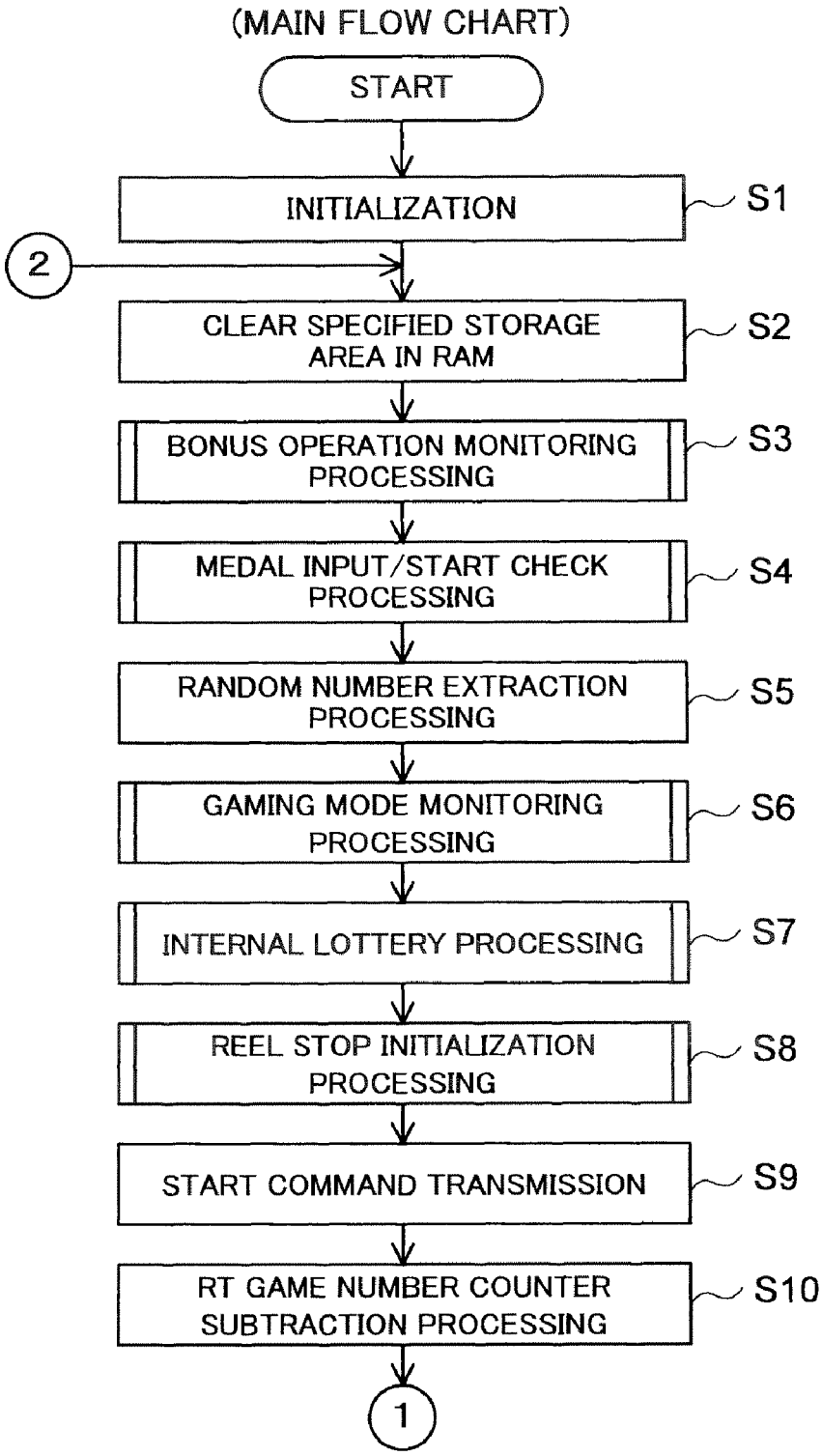
FIG. 20 is a main flow chart of a main control circuit.

Whether an RT interval occurs or not can be determined based on whether or not an RT game number counter is equal to or more than 1. 50 is set to the RT game number counter when the base gaming mode starts after an MB is realized (step S134 in FIG. 30 described later). 1 is subtracted from the counter value per game (step S10 in FIG. 20 described later). If internal winning of an MB occurs, the value of the counter is cleared to 0.

Whether a carryover interval occurs or not can be determined based on the presence/absence of a carryover combination. If an interval has no carryover combination and the value of the RT game number counter is 0, the interval is a normal interval.

The CB gaming mode is basically a gaming mode constituted by games in which "a second-type special accessory" is operating. In the CB gaming mode, the left reel 3L is not controlled (the maximum number of sliding pieces is 1) and the maximum number of sliding pieces of other reels is 4. The maximum number of sliding pieces is four in a gaming mode other than the CB gaming mode. The number of sliding pieces is a movement magnitude of symbols after the corresponding stop button is operated.

The CB gaming mode is determined by whether a CB operating flag is on or off. The CB operating flag is information for recognizing whether the gaming mode is the CB gaming mode. A condition for the CB operating flag being updated to on is that an MB operating flag described later is on. A condition for the CB operating flag being updated to off (step S131 in FIG. 30 described later) is that a game ends.

The MB operating flag is information for recognizing whether an advantageous state has been generated by realization of MB. An expected value of the play value granted to the player relative to the unit play value (for example, one medal betted on a game) used for game playing in the advantageous state is relatively higher than that in the general playing statue (the degree of advantage is relatively high). A condition for the MB operating flag being updated to on is that MB is realized. MB is a continuous accessory actuator related to the second-type special accessory. A condition for the MB operating flag being updated to off is that the number of paid out medals exceeds the number of payable medals (the bonus end number counter becomes 0). The number of payable medals is the number of medals that can be paid out in the game between the time the MB operating flag is updated to on and the time the MB operating flag is updated to off. When an MB is realized, 250 is set as an initial value for the bonus end number counter.

Here, the relationship between the MB operating flag and the CB operating flag between the time the MB operating flag is updated to on and the time the flag is updated to off will be described. When MB is realized, the MB operating flag is updated to on. If the MB operating flag is on, the CB operating flag is updated to on. Then, when the game ends, the CB operating flag is updated to off. If the MB operating flag is on when a game starts, the CB operating flag is updated to on again.

The MB operating flag is updated to off if a condition for updating the MB operating flag to off is satisfied and, when the MB operating flag is updated to off, a state in which the CB operating flag is updated to off will be maintained. When the MB operating flag is on, the CB operating flag is updated to on. That is, after an MB is realized, the CB gaming mode will continue until the MB operating flag is updated to off.

Figure 8:
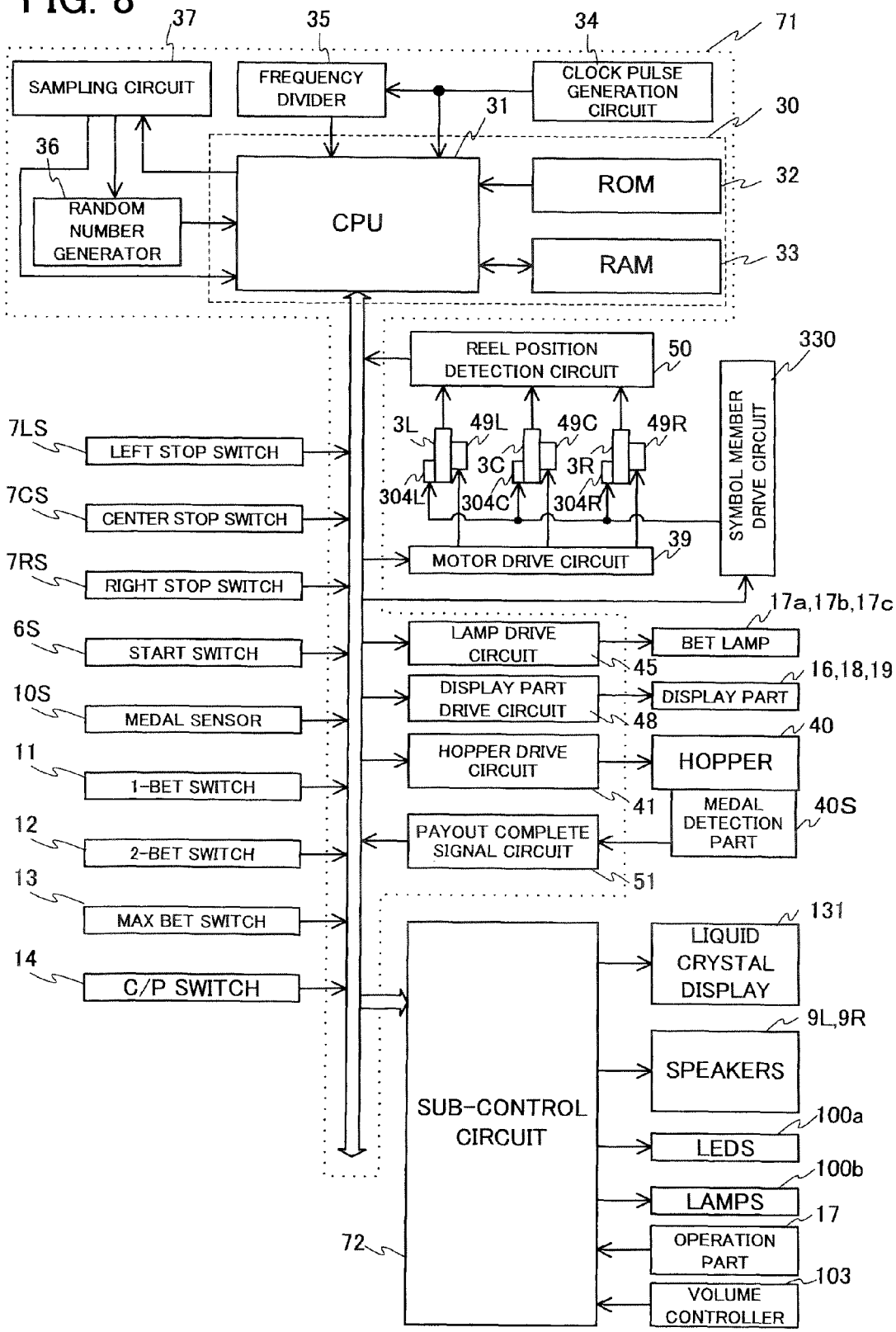
FIG. 8 is a block diagram showing a configuration of an electric circuit.

FIG. 8 shows a circuit configuration including a main control circuit 71 controlling the game processing operation of the gaming machine 1, peripheral devices electrically connected to the main control circuit 71, and a sub-control circuit 72 controlling the liquid crystal display 131, the speakers 9L and 9R, LEDs 100*a*, and lamps 100*b* based on control commands transmitted from the main control circuit 71.

The main control circuit 71 has a microcomputer 30 arranged on a circuit board as a main component thereof, and is also provided with a circuit for random number sampling. The microcomputer 30 comprises the CPU 31 that performs a control operation according to preset programs (See FIGS. 20 to 32 described later) and the ROM 32 and RAM 33, which are storage devices.

A clock pulse generation circuit 34 generating a standard clock pulse, a frequency divider 35, a random number generator 36 generating a random number to be sampled, and a sampling circuit 37 are connected to the CPU 31. Incidentally, a device for random number sampling may also be constituted by performing random number sampling in the microcomputer 30, that is, in the operating program of the CPU 31. In this case, the random number generator 36 and the sampling circuit 37 can be omitted, or may be remained as a back up for the random number sampling.

In the ROM 32 of the microcomputer 30, the internal lottery table (FIG. 14 described later) used for determining random number sampling each time the start lever 6 is operated (operated to start), stop tables for determining a stop mode of a reel according to a stop button operation, and the like are stored. Also, various control commands for transmission to the sub-control circuit 72 are stored. The sub-control circuit 72 never inputs a command or information into the main control circuit 71 and one-way communication is always performed from the main control circuit 71 to the sub-control circuit 72. In the RAM 33, various types of information are stored and various storage areas are set up. For example, information such as internal lottery combinations, carryover combinations, and the current gaming mode is stored in the RAM 33.

Main peripheral devices in the circuit of FIG. 8 whose operation is controlled by a control signal from the microcomputer 30 include the BET lamps (1-BET lamp 17*a*, 2-BET lamp 17*b*, and max BET lamp 17*c*), display parts such as the bonus game information display part 16, payout display part 18, and credit display part 19, a hopper (including a driver for payout) that accommodates medals and pays out the predetermined number of medals according to instructions of a hopper drive circuit 41, the stepping motors 49L, 49C, and 49R driving the reels 3L, 3C, and 3R to rotate, and the actuators 304L, 304C, and 304R driving the symbol members 191 and 192 to slide.

Moreover, a motor drive circuit 39 performing drive control of the stepping motors 49L, 49C, and 49R, the hopper drive circuit 41 performing drive control of the hopper 40, a lamp drive circuit 45 performing drive control of the BET lamps 17*a*, 17*b*, and 17*c*, a display part drive circuit 48 performing drive control of the display parts such as the bonus game information display part 16, payout display part 18, and credit display part 19, and the symbol member drive circuit 330 performing drive control of the actuators 304L, 304C, and 304R are connected to an output part of the CPU 31. These drive circuits control the operations of each actuator by receiving a control signal such as a drive command output from the CPU 31.

The main input signal generators that generate an input signal required by the microcomputer 30 to generate a control command include the start switch 6S, the stop switches 7LS, 7CS, and 7RS, the 1-BET switch 11, the 2-BET switch 12, and the max BET switch 13, the C/P switch 14, the medal sensor 10S, the reel position detection circuit 50, and the payout complete signal circuit 51.

The start switch 6S detects the operation of the start lever 6 and outputs a game start command signal (signal to instruct the start of the game). The medal sensor 10S detects a medal input into the medal input slot 10. The stop switches 7LS, 7CS, and 7RS generate a stop command signal (signal to instruct the stopping of the symbol variables) according to an operation of the corresponding stop buttons 7L, 7C, and 7R. The reel position detection circuit 50 receives a pulse signal from a reel rotation sensor and supplies a signal for detecting the position of each reel 3L, 3C, and 3R to the CPU 31. The payout complete signal circuit 51 generates a signal for detecting medal payout completion when a counter value (the number of medals paid out from the hopper 40) of a medal detection part 40S reaches a specified number.

In the circuit of FIG. 8, the random number generator 36 generates a random number within a certain numerical range and the sampling circuit 37 performs sampling of one random number in a timely fashion after the start lever 6 is operated. By using random numbers sampled in this manner, the internal symbol combinations and the like are determined based on, for example, the internal lottery table (FIG. 14 described later) stored in the ROM 32. An internal symbol combination (internal symbol combination data) can be said to provide an indirect correspondence between a combination of symbols and the award to be granted to a player via a stop control mode corresponding to the internal symbol combination and the like.

After rotation of the reels 3L, 3C, and 3R is started, the number of driving pulses supplied to each of the stepping motors 49L, 49C, and 49R is counted and the counter value is written into a predetermined area in the RAM 33. A reset pulse is obtained per rotation from the reels 3L, 3C, and 3R and these pulses are input into the CPU 31 via the reel position detection circuit 50. Reset pulses obtained in this manner clear the counter value of the driving pulses counted by the RAM 33 to "0." Thus, a counter value corresponding to the rotation position within the range of one rotation of each of the reels 3L, 3C, and 3R is stored in the RAM 33.

To establish a correspondence between the rotation position of the reels 3L, 3C, and 3R and symbols presented on an outer circumferential surface of the reels, a symbol arrangement table (FIG. 11 described later) is stored in the ROM 32. In the symbol arrangement table, the correspondences between the code number to be sequentially assigned after each of a certain amount of rotation of each reel 3L, 3C, and 3R and a symbol code showing a symbol provided corresponding to each code number are established.

Moreover, the symbol combination table (FIG. 12 described later) is stored in the ROM 32. In the symbol combination table, the correspondence between a combination of symbols (combination of symbols corresponding to a symbol combination described later) for realizing a winning combination, the number of medals to be paid out corresponding to the symbol combination described later, and the winning determination code (realization determination code), which is not shown, showing the winning (realization) is established. The symbol combination table is referenced for the stop control of the left reel 3L, center reel 3C, and right reel 3R, winning confirmation after all reels 3L, 3C, and 3R stop, determination of the number of medals to be paid out, and drive control of the symbol members 191 and 192. The symbol combination (symbol combination data) is basically a combination (realization combination) corresponding to a combination of symbols lining up along the active line. An award corresponding to the symbol combination is granted to the player.

If the internal symbol combination is determined by lottery processing (such as internal lottery processing) based on the above random number sampling, the CPU 31 transmits, when the player operates the stop button 7L, 7C, or 7R, an operation signal transmitted from the stop switch 7LS, 7CS, or 7RS and a signal to perform a stop control operation of the reel 3L, 3C, or 3R based on the determined stop table to the motor drive circuit 39.

If, a stop mode indicating winning of an internal symbol combination occurs, the CPU 31 supplies a drive signal to the symbol member drive circuit 330 to drive the actuators 304L, 304C, and 304R for a predetermined time. The CPU 31 also supplies a payout command signal to the hopper drive circuit 41 to pay out a predetermined number of medals from the hopper 40. At this point, the medal detection part 40S counts the number of medals paid out from the hopper 40 and when the counter number reaches a specified number, a medal payout complete signal is input into the CPU 31. Based on the medal payout complete signal, the CPU 31 stops driving the hopper 40 via the hopper drive circuit 41 to complete the medal payout processing.

Figure 9:
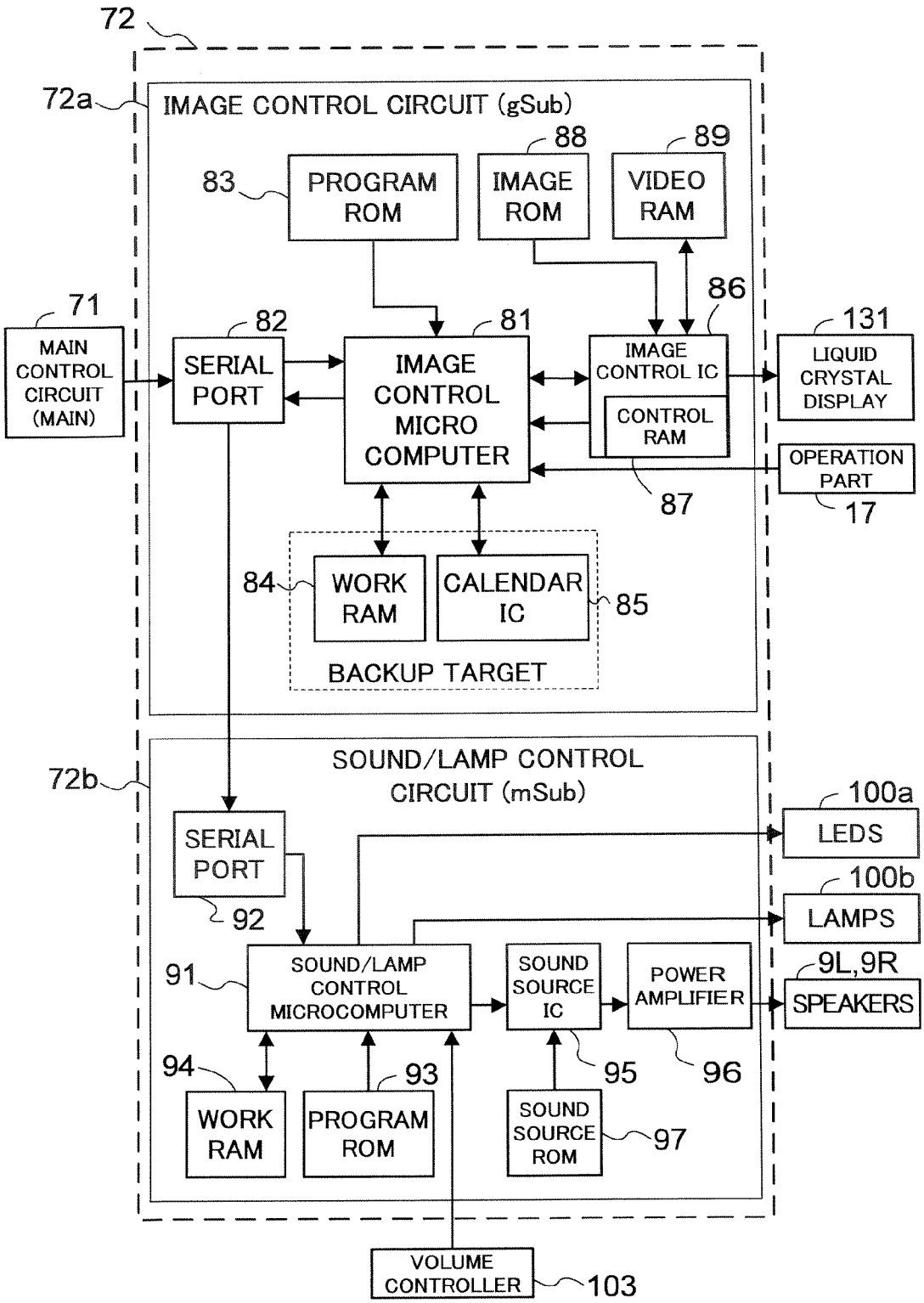
FIG. 9 is a block diagram showing a configuration of a sub-control circuit.

FIG. 9 is a block diagram showing the configuration of the sub-control circuit 72. The sub-control circuit 72 is comprised of an image control circuit (g Sub) 72*a* and a sound/lamp control circuit (m Sub) 72*b*. The image control circuit (g Sub) 72*a* and the sound/lamp control circuit (m Sub) 72*b* are each constituted on a different circuit board from that of the main control circuit 71.

Communication between the main control circuit 71 and the image control circuit (g Sub) 72*a* is performed uni-directionally from the main control circuit 71 to the image control circuit (g Sub) 72*a* and the image control circuit (g Sub) 72*a* never inputs a command or information into the main control circuit 71. Communication between the image control circuit (g Sub) 72*a* and the sound/lamp control circuit (m Sub) 72*b* is performed uni-directionally from the image control circuit (g Sub) 72*a* to the sound/lamp control circuit (m Sub) 72*b* and the sound/lamp control circuit (m Sub) 72*b* never inputs a command or information into the image control circuit (g Sub) 72*a*.

The image control circuit (g Sub) 72*a* is comprised of an image control microcomputer 81, a serial port 82, program ROM 83, work RAN 84, a calendar IC 85, an image control IC 86, control RAM 87, image ROM (CROM (character ROM)) 88 and video RAM 89.

The image control microcomputer 81 comprises a CPU, an interrupt controller, and an input/output port (the serial port is shown). The CPU in the image control microcomputer 81 performs various kinds of processing according to control programs stored in the program ROM 83 based on a command transmitted from the main control circuit 71. The image control circuit (g Sub) 72*a* is not equipped with a clock pulse generation circuit, a frequency demultiplexer, a random number generator, or a sampling circuit, but is constituted to perform random number sampling in an operating program of the image control microcomputer 81.

The serial port 82 receives commands and the like transmitted from the main control circuit 71. In the program ROM 83, control programs (FIGS. 33 to 35 described later) executed in the image control microcomputer 81, various tables and the like are stored. The work RAM 84 is constituted as a temporary storage unit for work when the image control microcomputer 81 executes the control programs. Various kinds of information are stored in the RAM 84. For example, information such as an MB notification flag is stored.

The calendar IC 85 stores date data. An operation part 17 is connected to the image control microcomputer 81. In the present embodiment, an employee of an amusement center should operate the operation part 17 to set the date and the like. The image control microcomputer 81 stores the set date information in the calendar IC 85 based on an input signal transmitted from the operation part 17. Date information stored in the calendar IC 85 will be backed up.

The work RAM 84 and calendar IC 85 are backup subjects. That is, even if power supplied to the image control microcomputer 81 is cut off, power will still be supplied to them to prevent deletion of stored information and the like.

The image control IC 86 generates an image according to representation content (such as the information mode representation) determined by the image control microcomputer 81 and outputs the image to the liquid crystal display 131 (FIG. 10 described later). For example, the image control IC 86 displays an image (dynamic image) of the Don-chan character 102 described later.

The control RAM 87 is incorporated in the image control IC 86. The image control microcomputer 81 writes information and the like into the control RAM 87 and reads information and the like from the control RAM 87. In the control RAM 87, registers of the image control IC 86, a sprite attribute table, and a color palette table are expanded. The image control microcomputer 81 updates registers of the image control IC 86 and the sprite attribute table at predetermined intervals.

The liquid crystal display 131, the image ROM 88, and the video RAM 89 are connected to the image control IC 86. Incidentally, a configuration in which the image ROM 88 is connected to the image control microcomputer 81 may also be adopted. In this case, the configuration may prove to be effective in the processing of a large amount of image data such as three-dimensional image data. In the image ROM 88, image data, dot data and the like for generating images are stored. The video RAM 89 is constituted as a temporary storage unit when generating an image using the image control IC 86. The image control IC 86 also transmits a signal to the image control microcomputer 81 each time the transfer of data of the video RAM 89 to the liquid crystal display 131 is completed.

In the image control circuit (g Sub) 72*a*, the image control microcomputer 81 also controls the sound/lamp representation. The image control microcomputer 81 determines the type of sound/lamp and output timing based on the determined representation. Then, the image control microcomputer 81 transmits a command to the sound/lamp control circuit (m Sub) 72*b* via the serial port at predetermined intervals. The sound/lamp control circuit (m Sub) 72*b* mainly outputs only sound/lamps according to the command transmitted from the image control circuit (g Sub) 72*a*.

The sound/lamp control circuit (m Sub) 72*b* is comprised of a sound/lamp control microcomputer 91, a serial port 92, program ROM 93, work RAM 94, a sound source IC 95, a power amplifier 96, and sound source ROM 97.

The sound/lamp control microcomputer 91 comprises a CPU, an interrupt controller, and an input/output port (the serial port is shown). The CPU in the sound/lamp control microcomputer 91 performs output processing of sound/lamps according to control programs stored in the program ROM 93 based on a command transmitted from the image control circuit (g Sub) 72*a*. Also, the LEDs 100*a* and lamps 100*b* are connected to the sound/lamp control microcomputer 91. The sound/lamp control microcomputer 91 transmits an output signal to the LEDs 100*a* and lamps 100*b* according to a command transmitted from the image control circuit (g Sub) 72*a* at predetermined intervals. This causes the LEDs 100*a* and lamps 100*b* to emit light in a predetermined mode.

The serial port 92 receives a command and the like transmitted from the image control circuit (g Sub) 72*a*. In the program ROM 93, control programs executed in the sound/lamp control microcomputer 91 and the like are stored. The work RAM 94 is constituted as a temporary storage unit for work when the sound/lamp control microcomputer 91 executes the control programs.

The sound source IC 95 generates a sound source based on a command transmitted from the image control circuit (g Sub) 72*a* and outputs the sound source to the power amplifier 96. The power amplifier 96 is an amplifier and the speakers 9L and 9R are connected to the power amplifier 96. The power amplifier 96 amplifies a sound source output from the sound source IC 95 and causes the speakers 9L and 9R to output the amplified sound source. The sound source RAM 97 stores sound source data (such as a phrase) for generating a sound source and the like.

Also, a volume controller 103 is connected to the sound/lamp control microcomputer 91. The volume controller 103 is operable by an employee of an amusement center and the volume output from the speakers 9L and 9R is controlled. The sound/lamp control microcomputer 91 performs a control operation to control the sound output from the speakers 9L and 9R to the input volume based on an input signal transmitted from the volume controller 103.

A representative example of the liquid crystal display part 2*b* will be described with reference to FIG. 10.

As shown in FIG. 10, the Don-chan character 102 (character image) related to the "Don-chan" symbol may be displayed as a representation in the liquid crystal display part 2*b*. This representation (information) informs the player that MB is an internal symbol combination (carryover combination) and is basically started when a start operation of a game for which MB is internally won is performed in a normal interval. This representation is performed if the MB notification flag described later is on.

However, if a minor combination is also internally won for the game for which MB is internally won in a normal interval, the representation is performed when a start operation of a game whose internal symbol combination is not Replay is performed in a carryover interval on the condition that MB is not realized. The Don-chan character 102 is displayed continuously until an MB is realized. That is, the Don-chan character 102 display ends when the MB is realized.

Here, in the present embodiment, if a plurality of combinations is determined as the internal symbol combination, the priority for display of the combinations in the active line is determined using a draw-in priority table (FIG. 17 described later). If Replay is internally won in a carryover interval, Replay is drawn in with priority over MB, which is a carryover combination. Replay is a combination that can play a game when realized regardless of the input of any play value.

Under the stop control of the reels in the carryover interval described above, the player can immediately recognize the internal winning of an MB after internal winning of the MB occurs by signaling the above notice on condition that the first game in the carryover interval has started regardless of the internal symbol combination. However, if internal winning of Replay occurs in the carryover interval, the MB basically cannot be realized even if the above notice has started because Replay is drawn with priority over the MB. Thus, it is disadvantageous for a novice that the MB is an internal symbol combination because the MB cannot be realized even though the winning of the MB is announced.

If Replay is realized, on the other hand, the next game can be played without consuming any medals. Thus, the player is assumed to always play the next game without quitting the game in which Replay is realized. Therefore, even if the above notice is not started in a game in which Replay is internally won in a carryover interval, there is no disadvantage for the player to quit the game regardless of the carryover of the MB.

Thus, in the present embodiment, if the above notice has not been made in a carryover interval, the above notice is started on the condition that the internal symbol combination is note replay. Since, after the above notice has started, the above notice continues until an MB is realized, a situation occurs in which the above notice is given in a game in which the internal symbol combination is a replay.

The symbol arrangement table will be described with reference to FIG. 11.

The symbol arrangement table has information of symbols presented on the outer circumferential surface corresponding to the symbol position (code number) of the reels 3L, 3C, and 3R. A combination of symbols lining up along the active line can be grasped based on the symbol arrangement table and the symbol combination table described later.

The symbol combination table will be described with reference to FIG. 12

As shown in FIG. 12, the symbol combination table has information of the symbol combination stopped and presented at each of the stop positions of three symbols linked by one active line and the number of payout medals for each input number of medals (BET number). The symbol combination table is also referenced when, after all reels 3L, 3C, and 3R have stopped, the actuators 304L, 304C, and 304R are moved sliding and the number of payout medals is determined according to a combination of symbols presented along the active line.

If, for example, a winning number described later is 1 (Red cherry), the symbol combination may be Red cherry. If "Red cherry—any—any" line up along the active line, Red cherry becomes the symbol combination. If the input number of the medals is 1, 15 medals are paid out, and if the input number of the medals is 3, 3 medals are paid out. Any indicates any symbol.

Likewise, if, for example, "Red 7—Bell—Bell" line up along the active line, Red 7 bell takes on the symbol combination. If the input number of medals is 1, 12 medals are paid out, and if the input number of medals is 3, 1 medal is paid out. In this case, "Red 7", which is the symbol member 191, is driven to slide. If "Don-chan—Bell—Bell" line up along the active line, Don-chan bell takes on the symbol combination. If the input number of medals is 1, 12 medals are paid out, and if the input number of medals is 3, 1 medal is paid out. Similarly in this case, "Don-chan", which is the symbol member 192, is driven to slide.

If, for example, "Red 7—Red 7—Red 7" (combination of symbols causing the actuator related to the second-type special accessory to operate) line up along the active line, MB1 takes on the symbol combination and the gaming mode changes to the CB gaming mode. In this case, all three symbol members 191 "Red 7" are driven to slide. All three symbol members 191 "Red 7" may be made to slide at the same time or at random.

In the present embodiment, "Red 7" and "Don-chan" are assigned to the symbol members 191 and 192 respectively and, if a combination of symbols related to "Red 7" and "Don-chan" appears, the symbol members 191 and 192 are caused to slide, but the present invention is not limited to this and all symbols presented on the reels may be symbol members that slide when the symbol members stop and line up along the active line.

Since the number of combined symbols that cause the continuous actuators for the second-type special accessory to operate is not specified, the number of combined symbols can freely be set. For example, a symbol arrangement that always draws in such as Bell and Replay can be made. For example, if the maximum number of payout medals of the continuous actuator (MB) related to the second-type special accessory is set to 250, 50 games after MB ending and MB internal winning may be adopted as terminating conditions for high-probability Replay.

An internal lottery table determination table will be described with reference to FIG. 13.

The internal lottery table determination table has information of the internal lottery table (FIG. 14 described later) corresponding to the gaming mode and the number of times a lottery occurs. In the base gaming mode, the internal lottery table (FIG. 14 described later) for the general gaming mode is selected and 9 is basically determined as the number of times the lottery occurs (step S71 described later). The number of times the lottery occurs is the number of times the processing required for determining the internal symbol combination is repeated.

More specifically, the number of times of the lottery occurs is the number of times to determine whether or not a random number is within a predetermined range (numerical range indicated by an upper limit and a lower limit corresponding to a winning number described later in FIG. 14). However, for a carryover interval, the number of times the lottery occurs determined as 9 is updated to 7 (step S73 described later).

The internal lottery table will be described with reference to FIG. 14. The internal lottery table is set up for each gaming mode and has information of the numerical range indicated by the upper limit and lower limit corresponding to the winning number for each input number of medals. FIG. 14 shows an internal lottery table for the base gaming mode. Other internal lottery tables than an internal lottery table for the base gaming mode such as an internal lottery table for the CB gaming mode are omitted.

In a determination (lottery) of the winning number based on an internal lottery table, whether a random number value is within a numerical range indicated by a lower limit and an upper limit corresponding to the winning number is determined in descending order of the winning number identical to the number of times the lottery occurs specified for each gaming mode until the winning number becomes 0. If a random number value is within a numerical range indicated by a lower limit and an upper limit, the corresponding winning number is won. The number of times of determining whether a random number value is within a numerical range indicated by a lower limit and an upper limit corresponding to the winning number is the same as that determined by the internal lottery table determination table in FIG. 13.

If a random number is never within a numerical range indicated by a lower limit and an upper limit until the winning number becomes 0, the winning number will be 0 (loss). A loss of the internal symbol combination means that a combination corresponding to an award of the player has not been won in the internal lottery. Also, a loss in the present embodiment is not a combination corresponding to any play value. A combination of symbols corresponding to a loss as an internal symbol combination can also be considered as any different combination of symbols from the combinations of symbols corresponding to a plurality of preset combinations, but in the present embodiment, it is assumed that no combination of symbols corresponding to a loss is provided.

Since the numerical ranges specified by an upper limit and a lower limit corresponding to each of a plurality of combinations are set to overlap while determining whether a random number is within the numerical range in descending order of the winning number until the winning number becomes 0, a plurality of combinations may be determined as the internal symbol combination. The internal symbol combination is determined based on the winning number that has won, the gaming mode, the number of input medals, and an internal symbol combination determination table (FIG. 15 described later).

If, for example, the number of input medals in the base gaming mode (playing intervals other than a carryover interval) is 3 and a random number extracted from a range of 0 to 65535 is 850, first the random number X (850)−lower limit L (544) is calculated for the winning number 9. The result of this calculation yields 0 or larger. Next, the random number X (850)−upper limit U (895) is calculated. The result of this calculation yields 0 or smaller. Thus, the random number is within a numerical range ($U \leqq R \leqq L$) indicated by a lower limit and an upper limit corresponding to the winning number and if the extracted random number is 850, the winning number 9 is won. If the winning number 9 is won, MB2 which corresponds to the winning number 9 takes on the internal symbol combination based on an internal symbol combination determination table (FIG. 12) described later.

Next, the random number R (850)−lower limit L (171) is calculated for the winning number 8. Since the result of this calculation yields 0 or larger, then, the random number R (850)−upper limit U (522) is calculated. The result of this calculation yields 0 or larger. Thus, the random number is not within the numerical range indicated by the lower limit and the upper limit and if the extracted random number is 850, the winning number 8 is not won.

By repeating the calculation of the random number R (850)−lower limit L and the calculation of the random number R (850)−upper limit U until the winning number becomes 0 in this manner, whether each of the winning numbers 7 to 1 is won is determined. If the extracted random number is 850, the winning numbers 7 to 2 are not won. In contrast, the lower limit L is 807 and the upper limit U is 1066 for the winning number 1. Thus, if the extracted random number is 850, the winning numbers 1 and 9 are won and, based on the internal symbol combination determination table (FIG. 15) described later, both Red cherry and MB2 are determined as the internal symbol combinations.

Since here the number of times the lottery occurs is updated to 7 (step S73 in FIG. 25 described later) in a carryover interval and there is no chance that the winning number 8 or 9 will win, there is no chance that MB1 or MB2 is determined as an internal symbol combination based on the internal symbol combination determination table (FIG. 15) described later in the carryover interval. In an RT interval, the upper limit corresponding to the winning number 7 and the number of input medals 1 is changed to 32217 and that corresponding to the number of input medals 3 is changed to 37808 and thus, the probability of internally winning Replay becomes relatively higher than in the normal and carryover intervals. More specifically, the probability of internally winning Replay in an RT interval is 29800/65536 when the number of input medals is 1 or 3. In a non-RT interval, the probability of internally winning Replay is 8980/65536 when the number of input medals is 1 or 3.

In a normal interval, the internal lottery table for base gaming mode has a lottery value 8980 of corresponding to the number of input medals 3 and the winning number 7. In an RT interval, on the other hand, the internal lottery table for base gaming mode has a lottery value of 29800 corresponding to the number of input medals 3 and the winning number 7. Thus, it can be said that a plurality of internal lottery tables for base gaming mode to determine the internal symbol combination are stored.

Here, the expected value K (expected value without consideration of a so-called an "unexpected defeat") of the number of medals paid out per "one medal" bet on a game will be described. The expected value K can basically be calculated by: {number of payout medals/BET number}×{probability of internal winning} for each internal symbol combination in a probability lottery table and adding them. The probability of internal winning is the value obtained by dividing the lottery value by 65536.

If K is an expected value in an RT interval in the base gaming mode when a game is played with the BET number 3, we obtain K as shown below:

$$
\begin{aligned}
K = {} & \{3/3\}\times\{260/(65536-29800)\} && \text{(Red cherry)} + \\
& \{3/3\}\times\{260/(65536-29800)\} && \text{(Blue cherry)} + \\
& \{12/3\}\times\{7300/(65536-29800)\} && \text{(Bell)} + \\
& \{1/3\}\times\{4/(65536-29800)\} && \text{(Red 7 bell)} + \\
& \{1/3\}\times\{4/(65536-29800)\} && \text{(BAR bell)} + \\
& \{1/3\}\times\{4/(65536-29800)\} && \text{(Don-chan bell)} \\
= {} & 0.832
\end{aligned}
$$

Here, if Replay is realized, the next game can be played without betting any medal, and thus Replay can be considered to be a combination that pays out no medals. Consequently, in the denominator of the internal winning probability, a probability lottery value of Replay ("29800") is subtracted from "65536."

Then expected value T of a net increase in the number of medals in a RT interval when 50 games are continued in the RT interval will be determined. Thus, the expected value K and the number of input medals (3×50) are multiplied to determine the number of payout medals and then the number of input medals 150 is subtracted from the calculated number of payout medals to obtain $$
\begin{aligned}
T &= K\times 150 - 150 \\
&= -25.24
\end{aligned}
$$

As described above, the expected value K is smaller than 1. Thus, an RT interval in the base gaming mode in which a game is played with the BET number 3 is disadvantageous to the player. Also, the probability "29800/65536" of winning a replay is set relatively high in the RT interval, as shown by the expected value T, but after playing out 50 games, about 20 to 30 medals decrease and thus the RT interval is basically disadvantageous to the player.

The internal symbol combination determination table will be described with reference to FIG. 15.

The internal symbol combination determination table has information (data) of the internal symbol combination (flag information) corresponding to the winning number. The flag is represented as a binary number. An internal symbol combination 1 and an internal symbol combination 2 shown corresponding to the winning number are information to distinguish the internal symbol combination and each of them is 1-byte data. The internal symbol combination 2 is basically related to a carryover combination.

If the winning number is 0 and the internal symbol combination 2 is "00000000" in the base gaming mode, the internal symbol combination is a loss. If the winning number is 1 and the internal symbol combination 2 is "00000001", the internal symbol combination is Red cherry. If the winning number is 2 and the internal symbol combination 2 is "00000010", the internal symbol combination is Blue cherry.

If the winning number is 3 and the internal symbol combination 2 is "00000100", the internal symbol combination is Bell. If the winning number is 4 and the internal symbol combination 2 is "00001000", the internal symbol combination is Red 7 bell. If the winning number is 5 and the internal symbol combination 2 is "00010000", the internal symbol combination is BAR bell. If the winning number is 6 and the internal symbol combination 2 is "00100000", the internal symbol combination is Don-chan bell.

If the winning number is 7 and the internal symbol combination 1 is "00000001", the internal symbol combination is Replay. If the winning number is 8 and the internal symbol combination 1 is "00000010", the internal symbol combination is MB1. If the winning number is 9 and the internal symbol combination 1 is "00000100", the internal symbol combination is MB2.

In the CB gaming mode, the internal symbol combination 2 is "00011111" and the internal symbol combination is the combined combination for any of the winning numbers 0 to 5.

The internal symbol combination (internal symbol combination data) is basically information for identifying a stop control mode and combinations that could become symbol combinations (combinations permitted as symbol combinations). An internal symbol combination can be said to provide an indirect correspondence between a corresponding combination of symbols and an award to be granted to a player via a stop control mode (stop table) corresponding to the internal symbol combination and the like.

A reel stop initial determination table will be described with reference to FIG. 16.

The reel stop initial determination table has information of the stop tables corresponding to each of the stop select counter values 0 to 9. The winning number is basically set to the stop select counter (step S106 in FIG. 27). However, if the internal symbol combination is the combined combination, 8 or 9 is set to the stop select counter (step S108 in FIG. 27).

The stop tables have information specifying the stop control modes of the reels 3L, 3C, and 3R. More specifically, the stop tables have information of the stop modes (for example, information of the symbol stop positions and that of the numbers of the sliding pieces) of the reels 3L, 3C, and 3R corresponding to the operation timing of the stop buttons 7L, 7C, and 7R by the player. Each stop table is basically constituted so that the corresponding internal symbol combination can be realized.

A draw-in priority table will be described with reference to FIG. 17.

The draw-in priority table has information of the relative priorities when drawing in a combination of symbols corresponding to a combination. "Drawing-in" is basically to cause the reels (reels corresponding to the stop operations), which are the targets of stop control, to stop so that symbols constituting a symbol combination corresponding to a draw-in target combination (hereinafter referred to as "draw-in target symbols") within the range of the maximum number of sliding pieces are presented at the symbol stop positions linked by the active line (hereinafter referred to as a "active symbol stop position") The draw-in target combination is a combination (internal symbol combination) corresponding to a symbol combination attempted to line up along the active line.

If, however, in the second stop operation or the third stop operation, symbols constituting a symbol combination corresponding to the draw-in target combination are presented at the active symbol stop position together with the draw-in target symbol corresponding to this stop operation, presenting draw-in target symbols at the active symbol stop position within the symbol display areas 21L, 21C, and 21R linked by the active line linking the active symbol stop position is called "draw-in."

Replay has the highest draw-in priority. MB has a higher priority than any combination other than Replay. Thus, if Replay is internally won when MB is carried over, Replay is realized by priority. If, on the other hand, a combination other than Replay is internally won when MB is carried over, MB is realized by priority.

Red cherry, Blue cherry, and Bell have a higher priority than Red 7 bell, BAR bell, and Don-chan bell. Thus, when controlling to stop the center and right reels 3C and 3R in the CB gaming mode, the drawing-in of Red cherry, Blue cherry, and Bell takes precedence over Red 7 bell, BAR bell, and Don-chan bell.

A bonus operation time table will be described with reference to FIG. 18.

The bonus operation time table has information of operating flags updated to on, the value to be set to the bonus end number counter, the number of medals available for game playing, and the allowable number of times to win. The bonus operation time table is referenced in the processing of step S144 in FIG. 31 described later.

The operating flags are information for identifying the operating gaming mode (current gaming mode). Among the operating flags, an MB operating flag corresponding to the symbol combination is provided.

The bonus end number counter is a counter to count the number of medals paid out in a game between the time when the MB operating flag updated to on and the time when the MB operating flag updated to off.

The internal symbol combination 1, internal symbol combination 2, and storage areas of the carryover combination and random numbers will be described with reference to FIG. 19.

(1) in FIG. 19 shows an internal symbol combination 1 storage area. In the internal symbol combination 1 storage area, information (data) of the internal symbol combinations is stored in the 1-byte internal symbol combination 1 storage area. Bit 0 (the first bit) in the internal symbol combination 1 storage area is a storage area corresponding to Replay. Bit 1 (the second bit) is a storage area corresponding to MB1.

Bit 2 (the third bit) is a storage area corresponding to MB2. Bit 3 (the fourth bit) to Bit 7 (the eighth bit) are unused storage areas. In the internal symbol combination 1 storage area, an object (combination) corresponding to a bit that is 1 becomes the internal symbol combination. If, for example, "00000010" is stored in the internal symbol combination 1 storage area (bit 1 (the second bit) is 1), and the internal symbol combination is MB1.

(2) in FIG. 19 shows an internal symbol combination 2 storage area. In the internal symbol combination 2 storage area, information (data) of the internal symbol combinations is stored in the 1-byte internal symbol combination 2 storage area. Bit 0 (the first bit) in the internal symbol combination 2 storage area is a storage area corresponding to Red cherry. Bit 1 (the second bit) is a storage area corresponding to Blue cherry.

Bit 2 (the third bit) is a storage area corresponding to Bell. Bit 3 (the fourth bit) is a storage area corresponding to Red 7 bell. Bit 4 (the fifth bit) is a storage area corresponding to BAR bell. Bit 5 (the sixth bit) is a storage area corresponding to Don-chan bell. Bit 6 (the seventh bit) and Bit 7 (the eighth bit) are unused storage areas. In the internal symbol combination 2 storage area, an object (combination) corresponding to a bit that is 1 becomes the internal symbol combination. If, for example, "00000010" is stored in the internal symbol combination 2 storage area (bit 1 (the second bit) is 1), the internal symbol combination is Blue cherry.

(3) in FIG. 19 is a carryover combination storage area. In the carryover combination storage area, information of the carryover combination is stored in the 1-byte carryover combination storage area. Bit 1 (the second bit) in the carryover combination storage area is a storage area corresponding to MB1. Bit 2 (the third bit) in the carryover combination storage area is a storage area corresponding to MB2. Bit 0 (the first bit) and Bit 3 (the fourth bit) to Bit 7 (the eighth bit) are unused storage areas. When there is a carryover combination (there is a carryover interval), 1 is stored in bit 1 (second bit) or bit 2 (third bit) corresponding to MB1 or MB2 in the carryover combination storage area ("0000010" or "00000100" is stored in the carryover combination storage area).

The control operation of the main control circuit 71 will be described with reference to the main flow chart shown in FIGS. 20 and 21.

First, the CPU 31 is initialized (step S1). More specifically, the storage contents of the RAM 33 are initialized and communication data is initialized, then the flow proceeds to step S2. In step S2, the storage contents of the RAM 33 are deleted (cleared). More specifically, data in write permitted areas of the RAM 33 used in the last game 33 is deleted, a write operation of parameters required for the next game into the write permitted areas of the RAM 33 is performed, a start address of a sequence program of the next game is specified and so on.

Figure 22:
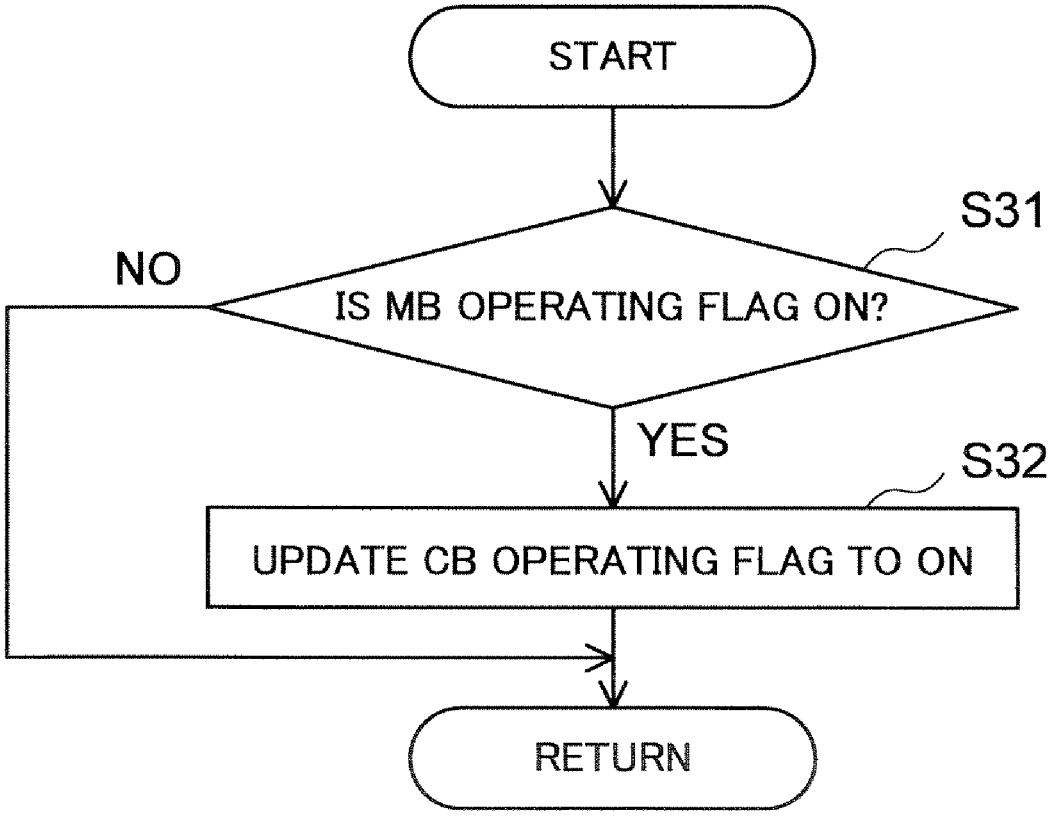
FIG. 22 is a flow chart showing the bonus operation monitoring processing.
Figure 23:
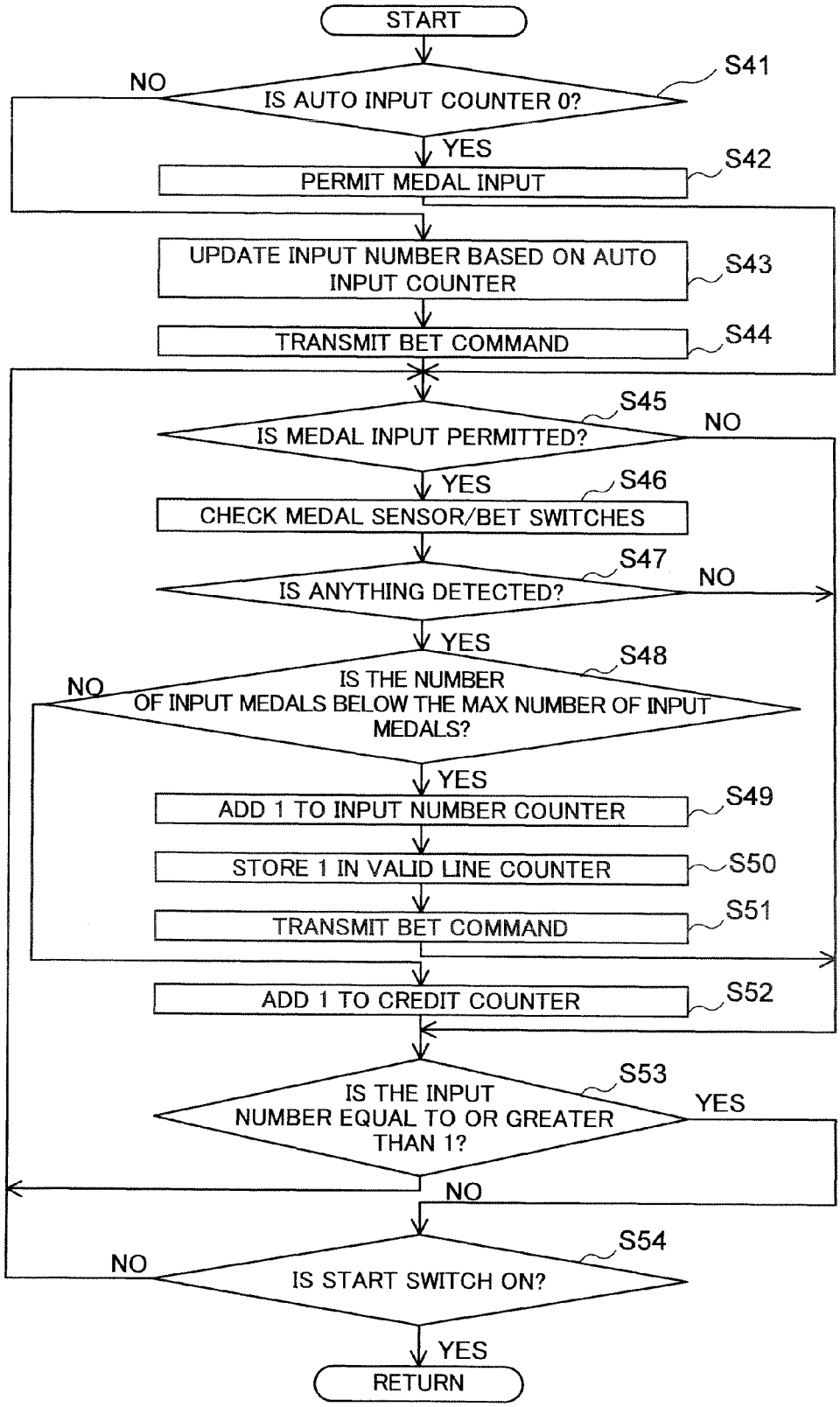
FIG. 23 is a flow chart showing the medal input/start check processing.

In step S3, a bonus operation monitoring process described later with reference to FIG. 22 is performed, then the flow proceeds to step S4. In step S4, the medal input/start check processing described later with reference to FIG. 23 is performed, then the flow proceeds to step S5. In this processing, processing such as changing the BET number based on input from the start switch 6S, the medal sensor 22S, or the BET switches 11 to 13 is performed.

Figure 24:
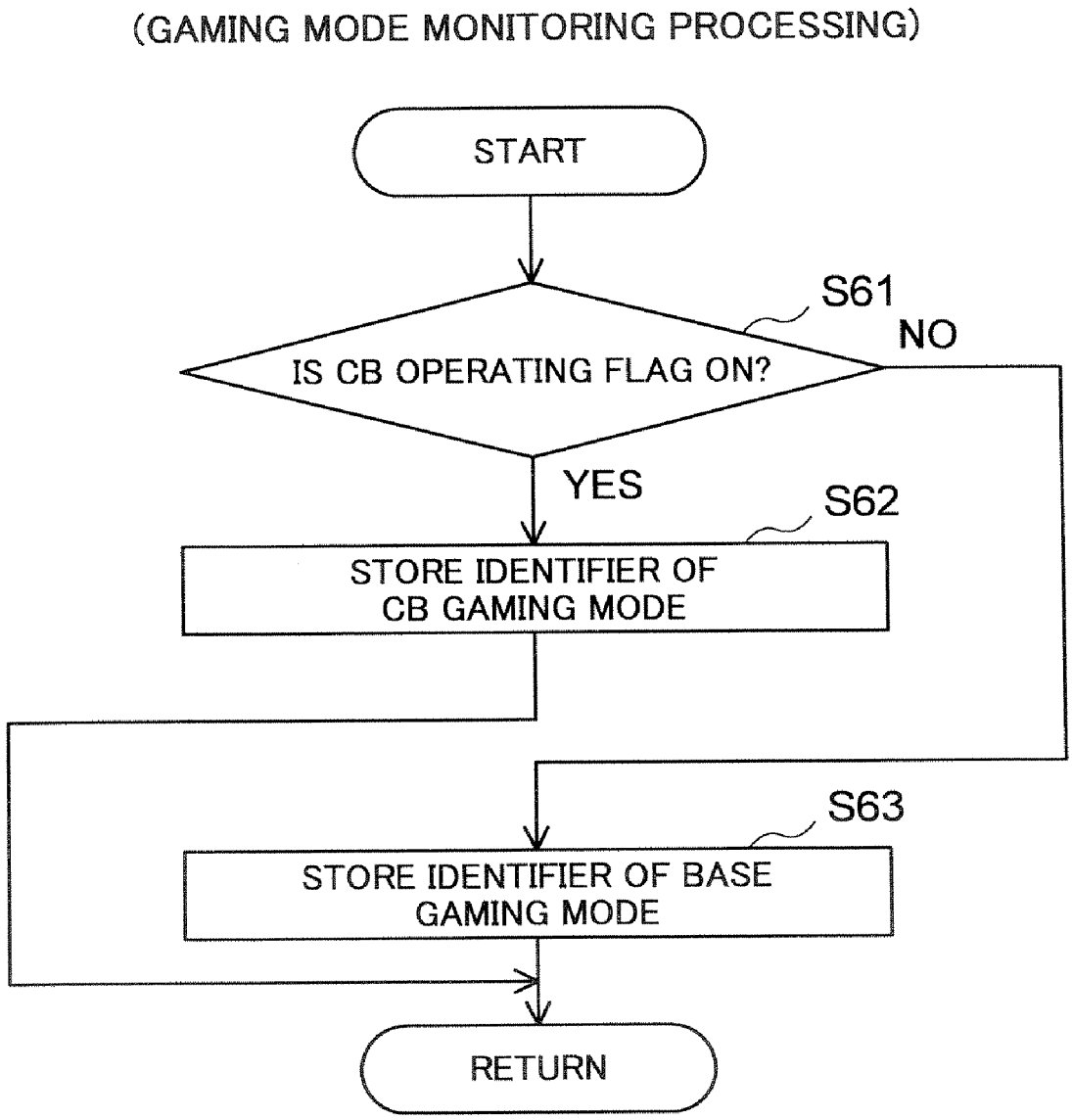
FIG. 24 is a flow chart showing the game mode monitoring processing.
Figure 25:
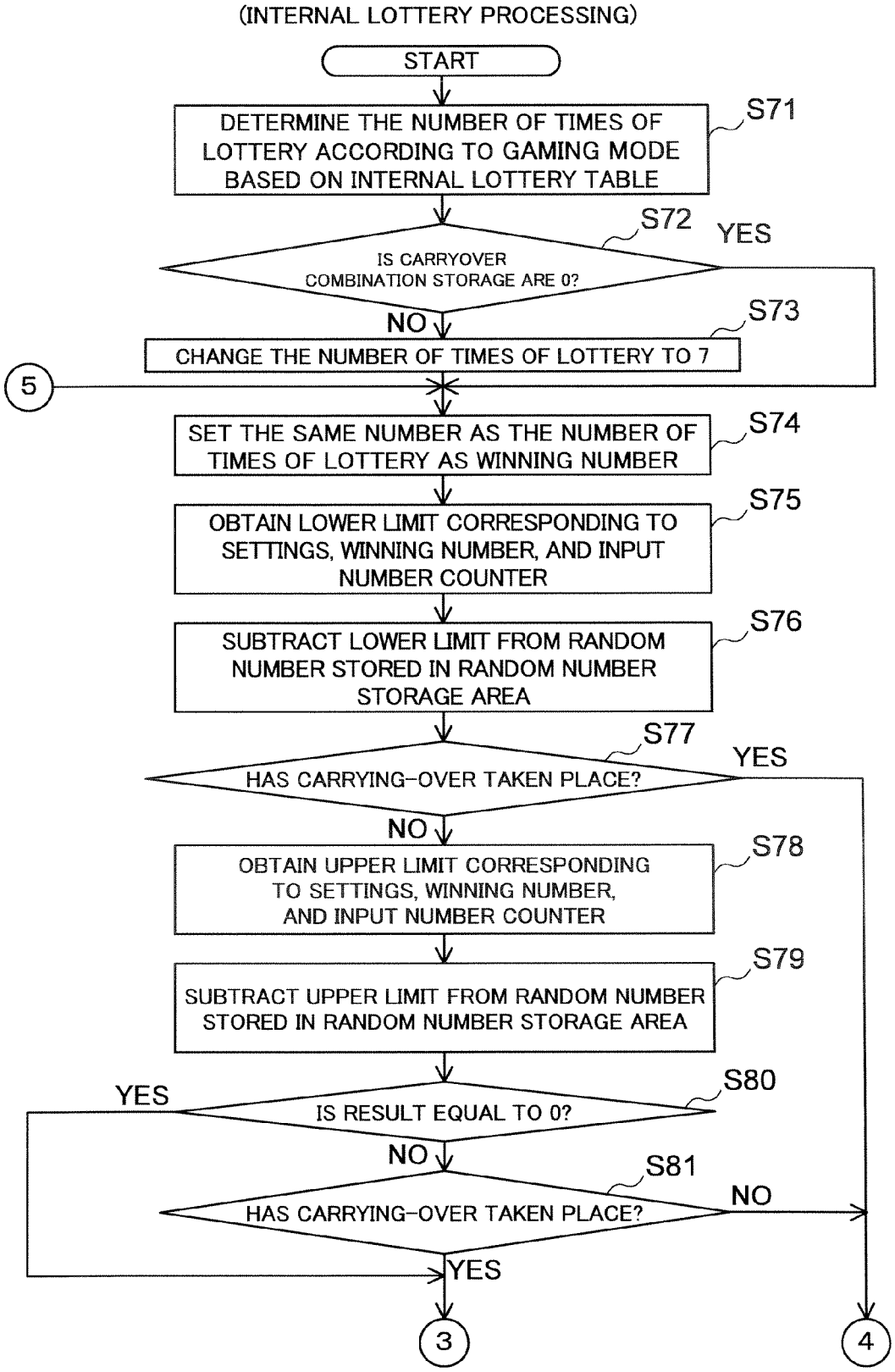
FIG. 25 is a flow chart showing the internal lottery processing.
Figure 27:
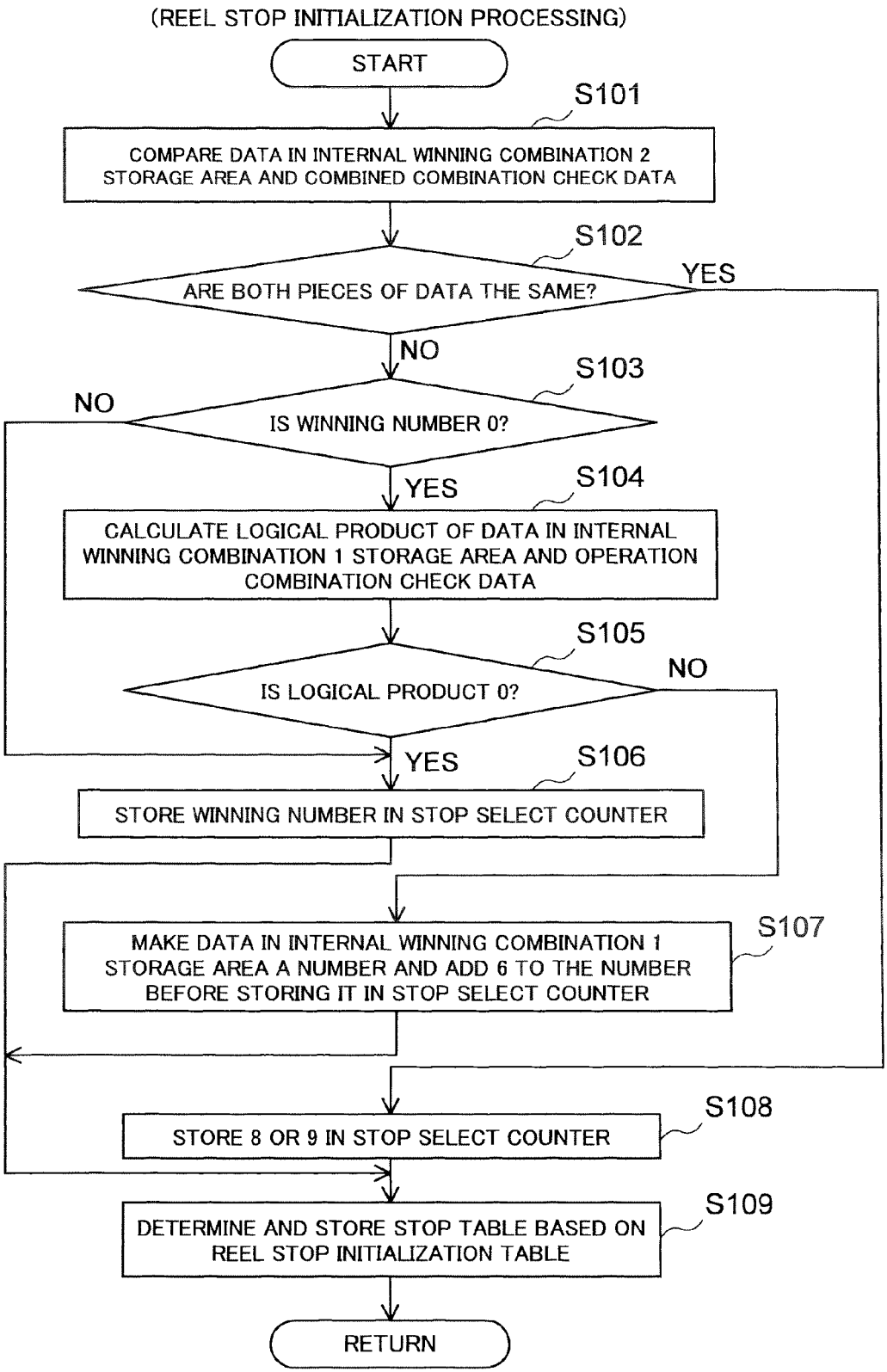
FIG. 27 is a flow chart showing the reel stop initialization processing.

In step S5, a random number for the lottery is extracted, then the flow proceeds to step S6. The random number extracted in this processing is used for internal lottery processing described later. In step S6, the gaming mode monitoring processing described later with reference to FIG. 24 is performed, then the flow proceeds to step S7. In step S7, the internal lottery processing described later with reference to FIG. 25 is performed, then the flow proceeds to step S8. In step S8, the reel stop initialization processing described later with reference to FIG. 27 is performed, then the flow proceeds to step S9.

In step S9, start command transmission is performed, then the flow proceeds to step S10. The start command includes information about the gaming mode, the internal symbol combination and the like and is transmitted to the sub-control circuit 72. In step S10, the RT game number counter subtraction processing is performed, then the flow proceeds to step S11 in FIG. 21. In the RT game number counter subtraction processing, is subtracted from the RT game number counter value if the counter value is 1 or more.

Figure 21:
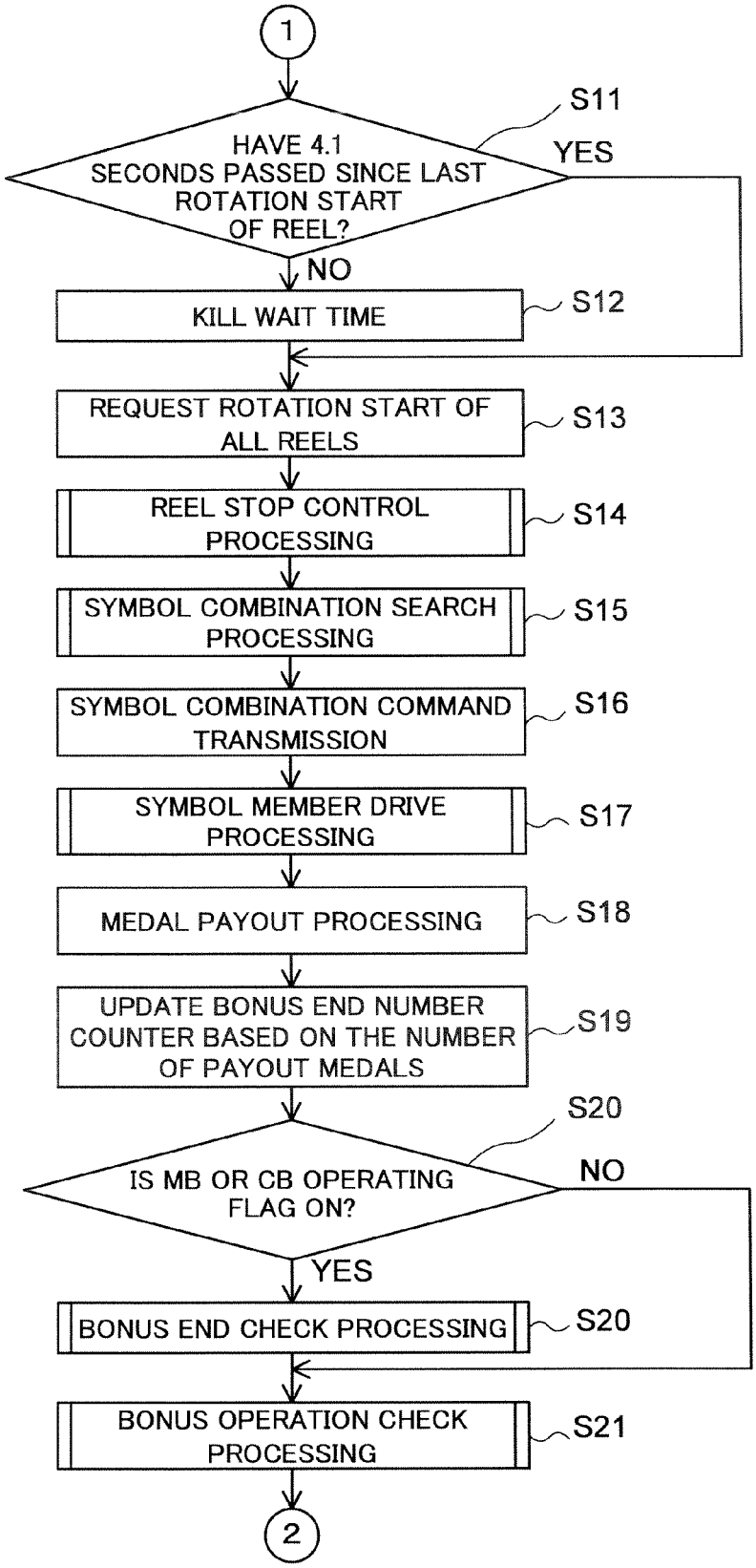
FIG. 21 is a flow chart continued from FIG. 20.

In step S11 in FIG. 21, whether 4.1 seconds have passed since the last reel rotation start is determined. YES for this determination leads to step S13 and NO for this determination leads to step S12. In step S12, processing (wait) to kill a game start wait time is performed, then the flow proceeds to step S13. More specifically, until a predetermined number of seconds (such as 4.1 seconds) have passed after starting the last game, processing to invalidate input based on an operation to start a game by a player is performed.

Figure 28:
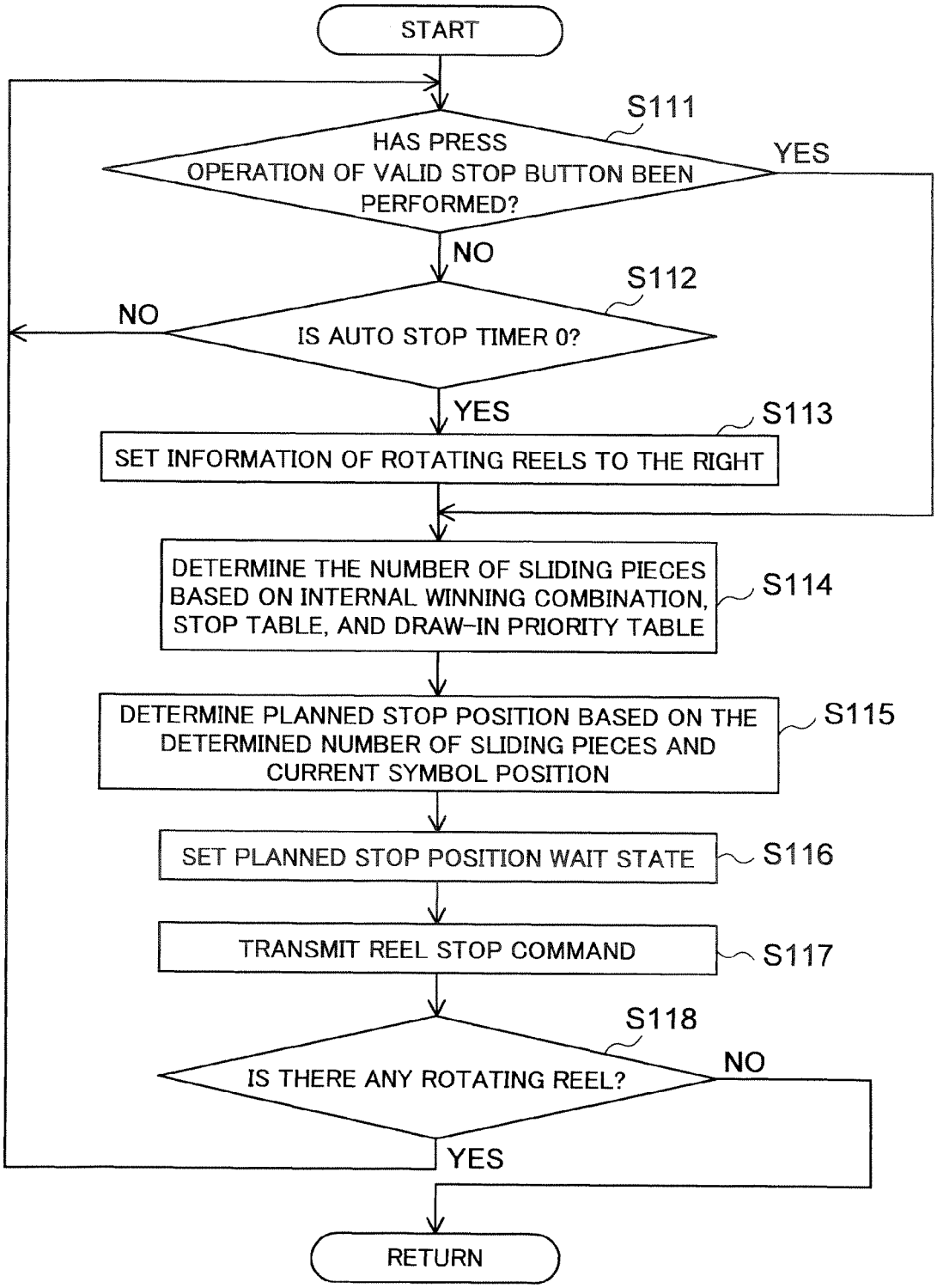
FIG. 28 is a flow chart showing the reel stop control processing.
Figure 29:
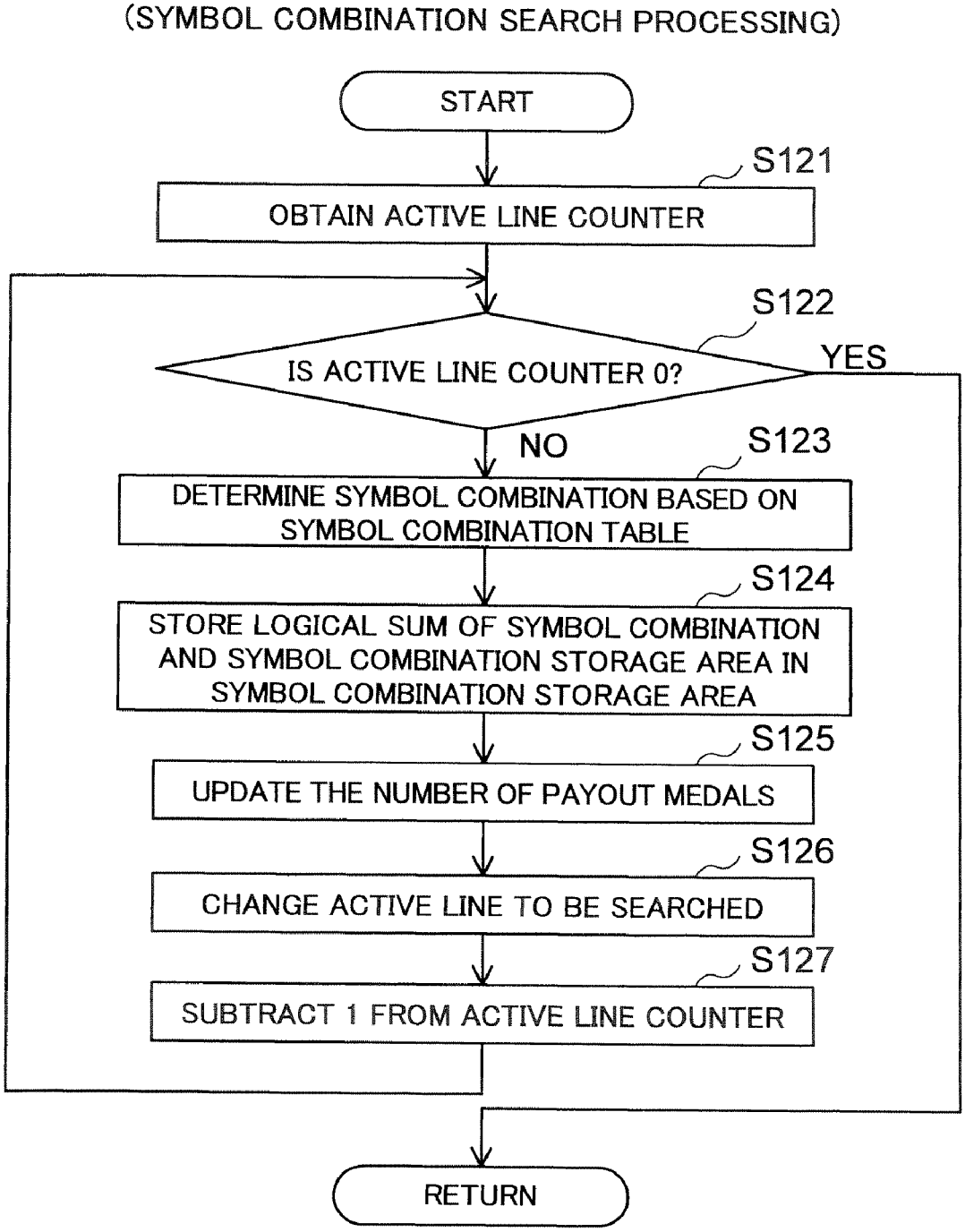
FIG. 29 is a flow chart showing the symbol combination search processing.

In step S13, rotation start of reels is requested, then the flow proceeds to step S14. In step S14, reel stop control processing described later with reference to FIG. 28 is performed, then the flow proceeds to step S15. In step S15, symbol combination search processing described later with reference to FIG. 29 is performed, then the flow proceeds to step S16. In step S16, symbol combination transmission is performed, then the flow proceeds to step S17.

Figure 30:
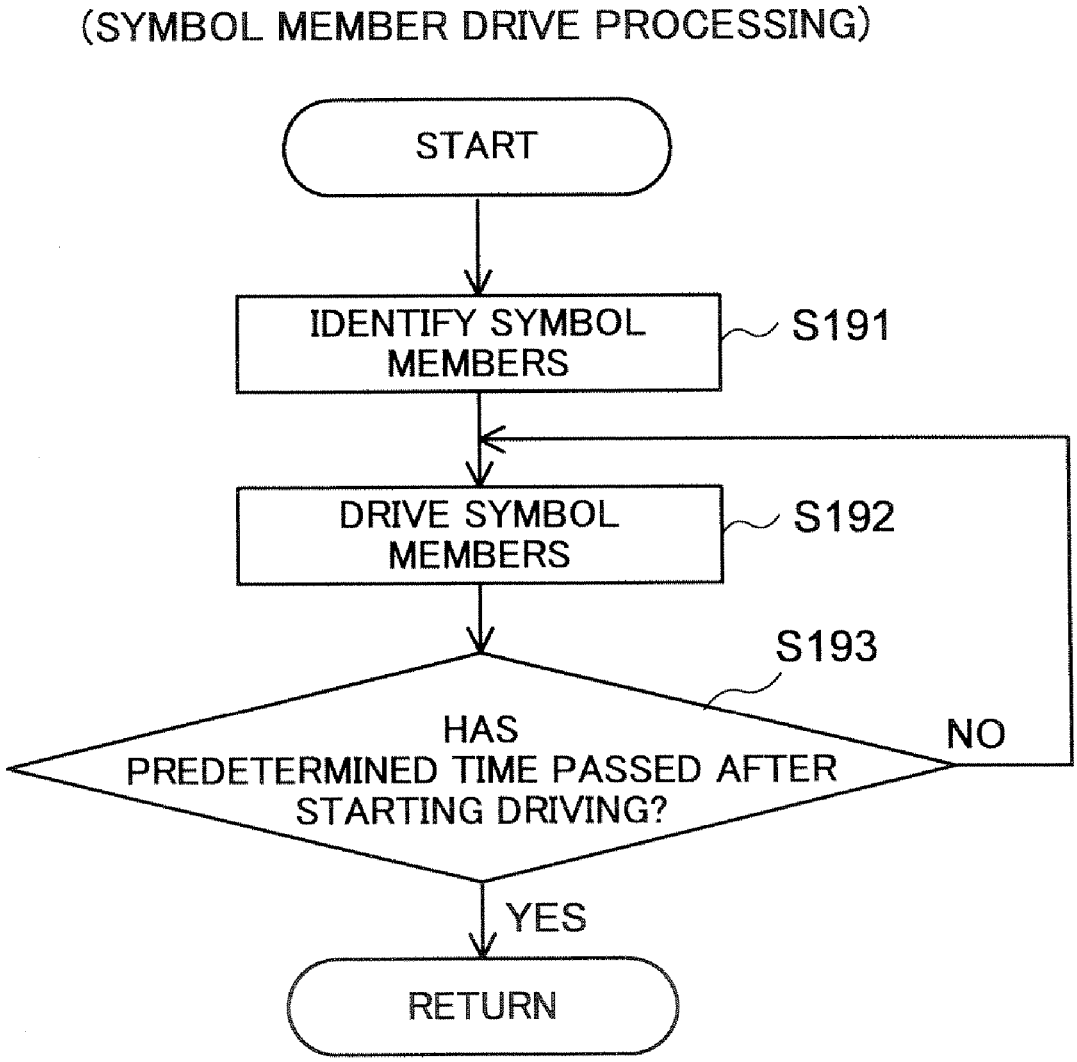
FIG. 30 is a flow chart showing the drive processing of symbol members.

In step S17, drive processing of the symbol members described later with reference to FIG. 30 is performed, then the flow proceeds to step S18. In step S18, medal payout processing is performed, then the slow proceeds to step S19. In step S19, the bonus end number counter is updated based on the number of payout medals, then the flow proceeds to step S20. If the bonus end number counter value is 1 or more, the counter value is subtracted according to the number of payout medals. In step S20, whether the MB operating flag or CB operating flag is on is determined. YES for this determination leads to step S21 and NO for this determination leads to step S22.

Figure 31:
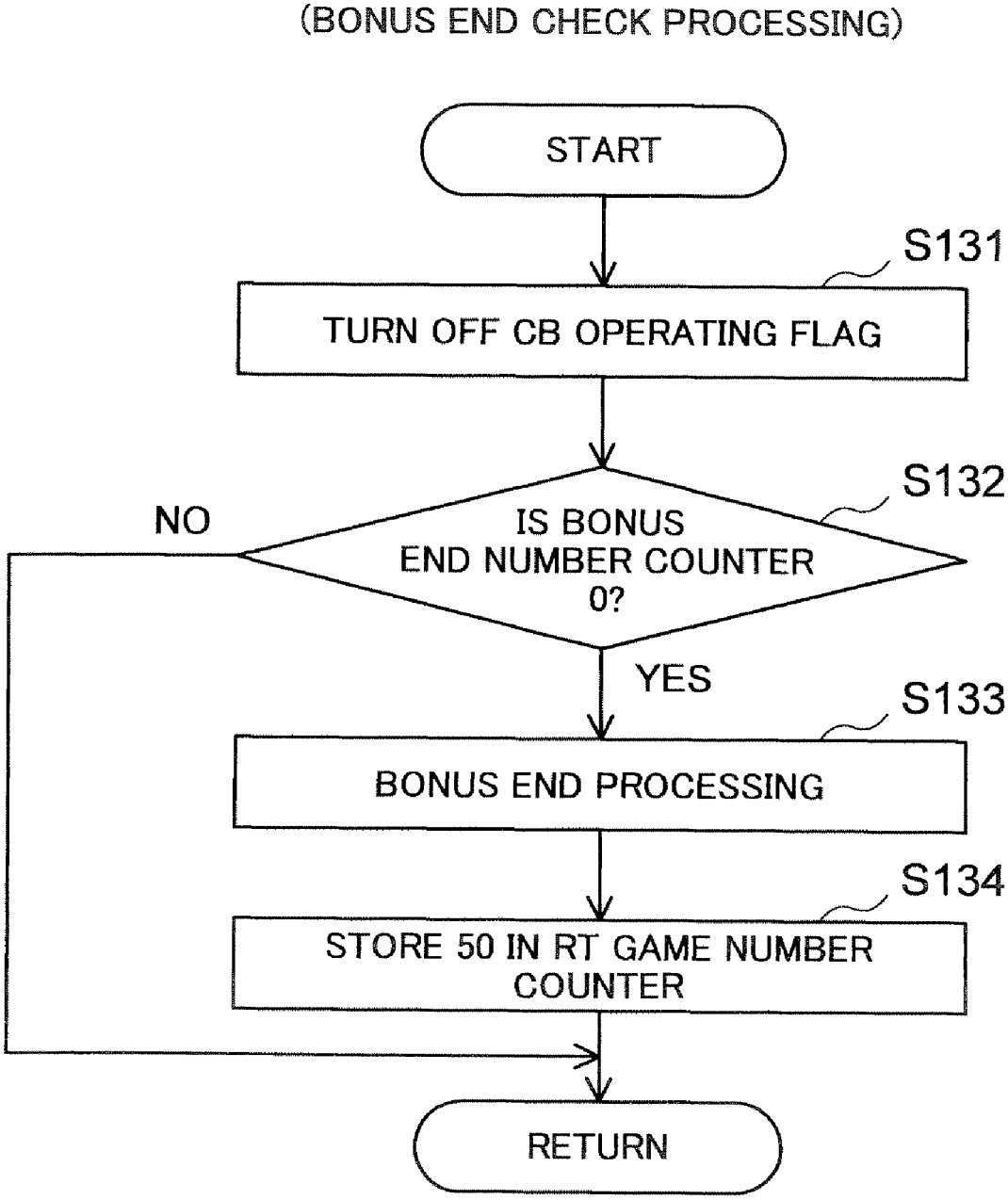
FIG. 31 is a flow chart showing the bonus end check processing.
Figure 32:
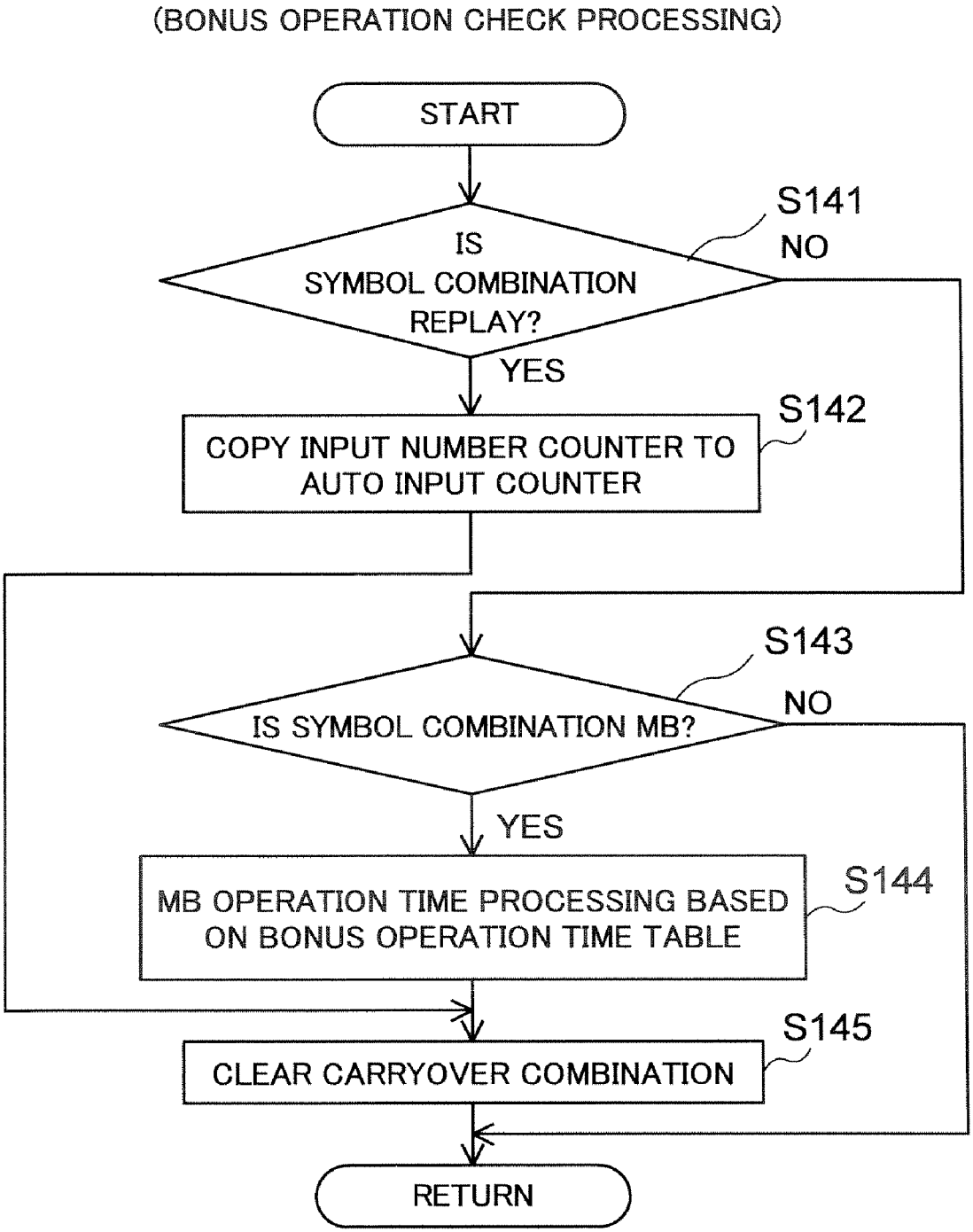
FIG. 32 is a flow chart showing the bonus operation check processing.

In step S21, bonus end check processing described later with reference to FIG. 31 is performed, then the flow proceeds to step S21. In step S21, bonus operation check processing described later with reference to FIG. 32 is performed, then the flow proceeds to step S2 in FIG. 20.

The bonus operation monitoring processing will be described with reference to FIG. 22.

First, the CPU 31 determines whether the MB operating flag is on (step S31). YES for this determination leads to step S32 and NO for this determination leads to step S4 in FIG. 20. In step S32, the CB operating flag is updated to on, then the flow proceeds to step S4 in FIG. 20.

The medal input/start check processing will be described with reference to FIG. 23.

First, the CPU 31 determines whether an auto input counter is 0, that is, whether a Replay was realized in the last game (step S41). YES for this determination leads to step S42 and NO for this determination leads to step S43. The auto input counter is a counter that counts the number of automatically input medals when the symbol combination is Replay. In step S42, the input of medals is permitted, then the flow proceeds to step S45. In step S43, the number of input medals (input number counter) is updated based on the auto input counter, then the flow proceeds to step S44. The input number counter is a counter that counts the number of input medals.

In step S44, the BET command transmission is performed, then the flow proceeds to step S45. In step S45, whether medal input is permitted is determined. YES for this determination leads to step S46 and NO for this determination leads to step S53. In step S46, the medal sensor/BET switch is checked, then the flow proceeds to step S47. More specifically, input from the medal sensor 10S or the BET switches 11 to 13 is checked.

In step S47, whether a signal from the medal sensor/BET switches has been detected, that is, whether any medal has been input is determined. More specifically, whether a signal from the medal sensor 10S or BET switches 11 to 13 has been detected is determined. YES for this determination leads to step S48 and NO for this determination leads to step S53. In step S48, whether the input number counter value is below the maximum number of input medals is determined. YES for this determination leads to step S49 and NO for this determination leads to step S52.

In step S49, 1 is added to the input number counter value, then the flow proceeds to step S50. In step S50, 1 is added to the active line counter value, then the flow proceeds to step S51. The active line counter is a counter to identify, among a plurality of active lines, the number of active lines whose symbol combination has been determined. In step S51, a BET command is transmitted, then the flow proceeds to step S53. In step S52, 1 is added to the credit counter, then the flow proceeds to step S53.

In step S53, whether the number of input medals is 1 or more is determined. YES for this determination leads to step S54 and NO for this determination leads to step S45. In step S54, whether the start switch is on is determined. YES for this determination leads to step S5 in FIG. 20 and NO for this determination leads to step S45.

The gaming mode monitoring processing will be described with reference to FIG. 24.

First, the CPU 31 determines whether the CB operating flag is on (step S61). YES for this determination leads to step S62 and NO for this determination leads to step S63. In step S62, an identifier of the CB gaming mode is stored, then the flow proceeds to step S7 in FIG. 20. In step S63, an identifier of the general gaming mode is stored, then the flow proceeds to step S7 in FIG. 20. In the gaming mode monitoring processing, as described above, the gaming mode is monitored based on the operating flag (CB operating flag) and information for selecting the type of internal lottery table according to the gaming mode is stored in the RAM 33 (gaming mode storage area) in step S71 in FIG. 25 described later.

Figure 26:
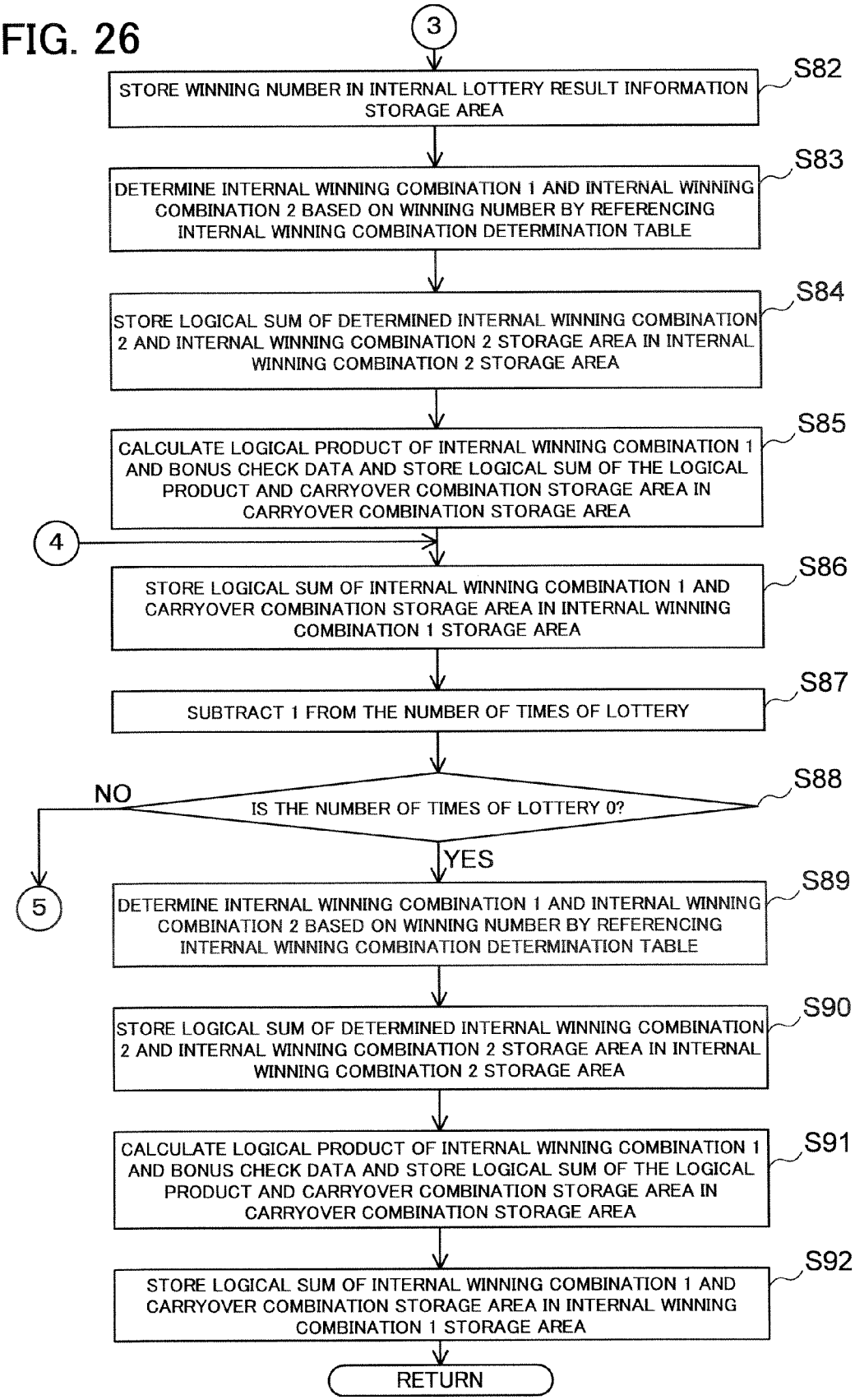
FIG. 26 is a flow chart continued from FIG. 25.

The internal lottery processing will be described with reference to FIGS. 25 and 26.

First, the CPU 31 determines the number of times the lottery occurs (step S71) based on the internal lottery table determination table (FIG. 13), then the flow proceeds to step S72. In step S72, whether or not data (information) stored in the carryover combination storage area is 0 (the presence/absence of the carryover combination) is determined. YES for this determination leads to step S74 and NO for this determination leads to step S73. Here, NO in step S72 is determined when the interval is a carryover interval. In step S73, the number of times the lottery occurs is updated to 7, then the flow proceeds to step S74.

In step S74, the same value as the number of times the lottery occurs is set to a register of the CPU 31 as the winning number, then the flow proceeds to step S75. This sets "9" for the base gaming mode, "6" for the CB gaming mode, and "7" for the internal winning state as the winning number. In step S75, the internal lottery table determined in step S71 is referenced and a lower limit (L) is obtained based on the winning number and the number of input medals, then the flow proceeds to step S76. In step S76, the lower limit (L) is subtracted from the random number (R) stored in the random number storage area in the RAM 33 (R−L), then the flow proceeds to step S77.

In step S77, a whether cancellation has occurred is determined. More specifically, whether the result of the calculation of (R−L) is negative is determined. YES for this determination leads to step S86 in FIG. 26 and NO for this determination leads to step S78. Here, YES is determined when the random number is smaller than the lower limit (L>R) and NO is determined when the random number is greater than or equal to the lower limit (R≦L).

In step S78, the internal lottery table determined in step S71 is referenced and an upper limit (U) is obtained based on the winning number and the number of input medals, then the flow proceeds to step S79. In step S79, the upper limit (U) is subtracted from the random number (R) stored in the random number storage area in the RAM 33 (R−U), then the flow proceeds to step S80.

In step S80, whether the value obtained by the subtraction, more specifically the calculation result of (R−U), is "0" is determined. YES for this determination leads to step S82 in FIG. 26 and NO for this determination leads to step S81. Here, YES is determined when the random number is equal to the upper limit (R=U) and NO is determined when the random number is not equal to the upper limit (R≠U).

In step S81, whether a cancellation has occurred is determined. More specifically, whether the result of the calculation of (R−U) is negative is determined. YES for this determination leads to step S82 in FIG. 26 and NO for this determination leads to step S86 in FIG. 26. Here, YES is determined when the random number is smaller than the upper limit (R<U) and NO is determined when the random number is greater than the upper limit (R>U).

In step S82, the winning number is stored in an internal lottery result information storage area of the RAM 33, then the flow proceeds to step S83. In step S83, the internal symbol combination determination table is referenced and the internal symbol combination 1 and internal symbol combination 2 are determined based on the winning number, then the flow proceeds to step S84. In step S84, the logical sum of the internal symbol combination 2 determined in step S83 and the internal symbol combination 2 storage area (FIG. 19) is stored in the internal symbol combination 2 storage area. Here, a bit corresponding to the minor combination type that has been won is set in the internal symbol combination 2 storage area.

In step S85, the logical product of the internal symbol combination 1 and the bonus check data is calculated and the logical sum of the logical product and a carryover combination storage area is stored in the carryover combination storage area, then the flow proceeds to step S86. This stores the determined MB in the carryover combination storage area. Incidentally, the bonus check data is "00010000." In step S86, the logical sum of the internal symbol combination 1 and the carryover combination storage area is stored in the internal symbol combination 1 storage area, then the flow proceeds to step S87. Here, a bit corresponding to MB or Replay that has been won is set in the internal symbol combination 2 storage area.

In step S87, 1 is subtracted from the number the times of lottery occurs then the flow proceeds to step S88. In step S88, whether or not the number of times the lottery occurs is 0 is determined. YES for this determination leads to step S89 and NO for this determination leads to step S74 in FIG. 25. Here, YES is determined when the number of times of determining whether a random number R is within a numerical range specified by an upper limit U and a lower limit L is nine times for the general gaming mode, six times for the MB gaming mode, and seven times for the internal win mode (carryover interval). On the other hand, NO is determined when the number of times of making the above determination is less than nine times for the general gaming mode, less than six times for the MB gaming mode, and less than seven times for the internal win mode (carryover interval).

In step S89, the internal symbol combination determination table is referenced and the internal symbol combination 1 and internal symbol combination 2 are determined based on the winning number, then the flow proceeds to step S90. In step S90, the logical sum of the determined internal symbol combination 2 and the internal symbol combination 2 storage area (FIG. 19) is stored in the internal symbol combination 2 storage area. In step S91, the logical product of the internal symbol combination 1 and bonus check data is calculated and the logical sum of the logical product and the carryover combination storage area is stored in the carryover combination storage area, then the flow proceeds to step S92. This stores the carryover combination in the carryover combination storage area. In step S92, the logical sum of the internal symbol combination 1 and the carryover combination storage area is stored in the internal symbol combination 1 storage area, then the flow proceeds to step S8 in FIG. 20. This ensures that, if a random number R does not belong to any numerical range of the internal lottery table in FIG. 14 and step S82 to step S86 have not been performed, a loss or the carryover combination will be stored in the internal symbol combination 1 storage area.

The reel stop initialization processing will be described with reference to FIG. 27.

First, the CPU 31 compares data in the internal symbol combination 2 storage area with the combined combination check data ("00011111") (step S101), then the flow proceeds to step S102. In step S102, whether data in the internal symbol combination 2 storage area and combined combination check data are the same is determined. YES (when the internal symbol combination is the combined combination) for this determination leads to step S108 and NO for this determination leads to step S103.

In step S103, whether or not the winning number is 0 is determined. YES for this determination leads to step S104 and NO for this determination leads to step S106. In step S104, the logical product of data in the internal symbol combination 1 storage area and operation combination check data ("00001111") is calculated, then the flow proceeds to step S105. In step S105, whether or not the logical sum is 0 is determined. YES for this determination leads to step S106 and NO (there is a carryover combination) for this determination leads to step S107.

In step S106, the winning number is stored in the stop select counter, then the flow proceeds to step S109. In step S107, data in the internal symbol combination 1 storage area is converted to a number and 6 is added to the number before storing the result in the stop select counter, then the flow proceeds to step S109. Data is converted to a number by setting 1 if bit 0 is on (1 is stored in bit 0), 2 if Bit 1 is on (1 is stored in bit 1), and 3 if bit 2 is on (1 is stored in bit 2). More specifically, if the data in the internal symbol combination 1 storage area indicates MB1 or MB2, 8 or 9 is respectively stored in the stop select counter.

In step S108, 8 or 9 is stored in the stop select counter, then the flow proceeds to step S109. More specifically, if the internal symbol combination is MB1, the stop select counter is set to 8 and, if the internal symbol combination is MB2, the stop select counter is set to 9. In step S109, the stop table is determined based on a reel stop initialization table, then the flow proceeds to step S9 in FIG. 20.

The reel stop control processing will be described with reference to FIG. 28.

First, the CPU 31 determines whether a pushing operation of an active stop button has been performed, that is, whether there has been input from any of the stop switches 7LS, 7CS, and 7RS (step S111). YES for this determination leads to step S114 and NO for this determination leads to step S112. In step S112, whether or not an auto stop timer is 0 is determined. YES for this determination leads to step S113 and NO for this determination leads to step S111.

In step S113, information of a rotating reel to the right is set, then the flow proceeds to step S114. Based on this information, for example, when a plurality of reels is rotating, reels automatically stop, starting with the right one. In step S114, the number of sliding pieces is determined based on the internal symbol combination, stop table, and draw-in priority table, then the flow proceeds to step S115. In step S115, the planned stop position (the position at which a symbol is caused to stop) is determined based on the determined number of sliding pieces and the current position of the symbol, then the flow proceeds to step S116. In step S116, a transition to a planned stop position wait state occurs, then the flow proceeds to step S117.

In step S117, a reel stop command transmission is performed, then the flow proceeds to step S118. In step S118, whether or not there is any rotating reel is determined. YES for this determination leads to step S111 and NO for this determination leads to step S15 in FIG. 21.

The symbol combination search processing will be described with reference to FIG. 29.

First, the CPU 31 obtains the active line counter (step S121), then the flow proceeds to step S122. When a game starts, 1 is stored in the active line counter (step S50). In step S122, whether or not the active line counter value is 0 is determined. YES for this determination leads to step S16 in FIG. 21 and NO for this determination leads to step S123. The active line counter value becomes 0 when a symbol combination search for one active line is completed.

In step S123, the symbol combination is determined based on the symbol combination table (FIG. 12), then the flow proceeds to step S124. In step S124, a logical sum of the symbol combination and the symbol combination storage area is stored in the symbol combination storage area, then the flow proceeds to step S125. In step S125, the number of payout medals is determined based on the symbol combination and the number of input medals, then the flow proceeds to step S126. In step S126, the active line to be searched is changed, then the flow proceeds to step S127. In step S127, 1 is subtracted from the active line counter value, then the flow proceeds to step S122.

The drive processing of the symbol members 191 and 192 will be described with reference to FIG. 30.

First, the CPU 31 identifies the symbol member 191 or 192 corresponding to the symbol combination (step S191), then the flow proceeds to step S192. In step S192, the symbol member 191 or 192 corresponding to the symbol combination is driven, then the flow proceeds to step S193. In step S193, whether a drive time of the symbol member 191 or 192 has passed a predetermined time (for example, 2 seconds) is determined. NO for this determination leads to step S192 and YES for this determination leads to step S18 in FIG. 21.

The bonus end check processing will be described with reference to FIG. 31.

First, the CPU 31 updates the CB operating flag to off (step S131), then the flow proceeds to step S132. In step S132, whether or not the bonus end number counter value is 0 is determined. YES for this determination leads to step S133 and NO for this determination leads to step S21 in FIG. 21. In step S133, the bonus end processing is performed, then the flow proceeds to step S134. In step S134, 50 is stored in the RT game number counter, then the flow proceeds to step S21 in FIG. 21.

The bonus operation check processing will be described with reference to FIG. 32.

First, the CPU 31 determines whether the symbol combination is Replay (step S141). YES for this determination leads to step S142 and NO for this determination leads to step S143. In step S142, the input number counter is copied to the auto input counter, then the flow proceeds to step S145. More specifically, in step S145, the same number as that of input medals for the game is set (auto input) to the auto input counter.

In step S143, whether the symbol combination is MB is determined. YES for this determination leads to step S144 and NO for this determination leads to step S2 in FIG. 20. In step S144, the MB operation time processing is performed based on the bonus operation time table then proceeding to step S145. In the MB operation time processing, the MB operation time flag is updated to on and the bonus end number counter is set to 250. In step S145, the carryover combination is cleared then proceeding to step S2.

Figure 33:
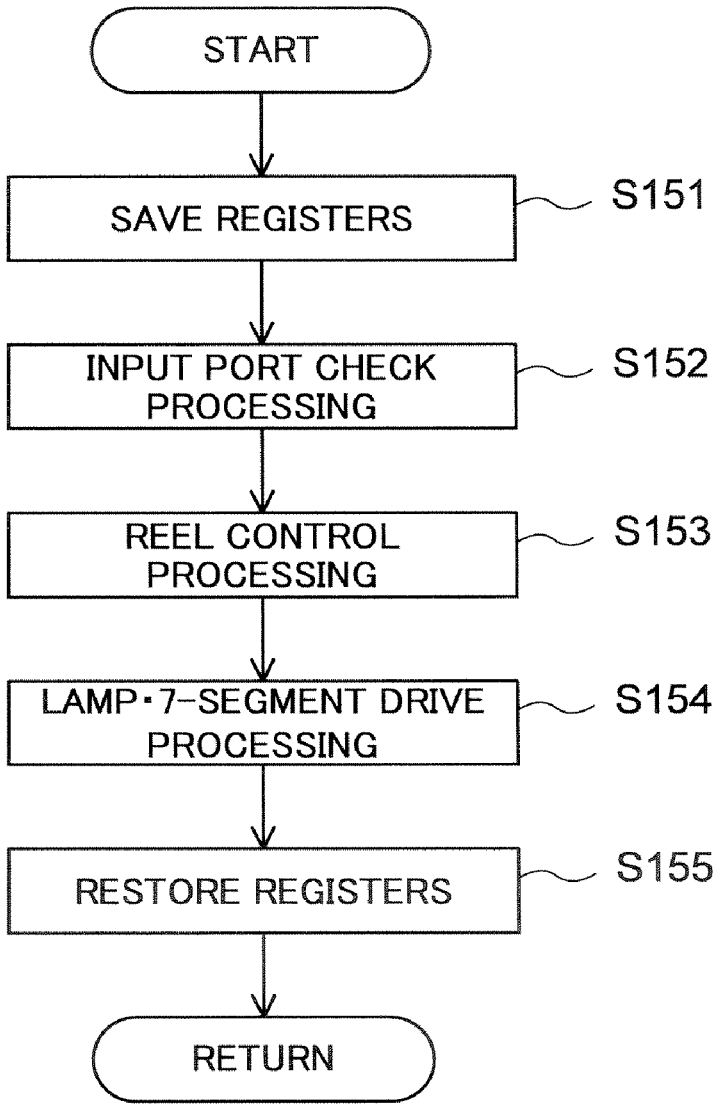
FIG. 33 is a flow chart showing the interrupt processing by main CPU control.

Interrupt processing by controlling the main CPU (CPU 31) will be described with reference to FIG. 33. This periodic interrupt processing is performed every 1.1173 ms.

First, the CPU 31 saves the registers (step S151), then the flow proceeds to step S152. In step S152, input port check processing is performed, then the flow proceeds to step S153. More specifically, input or the like from the start switch 6S by pushing the start lever 6 is checked for. In step S153, reel control processing is performed, then the flow proceeds to step S154. More specifically, information indicating a reel to be controlled is set as a reel identifier to control driving of the reel.

In step S154, lamp/7 segment drive processing is performed, then the flow proceeds to step S155. More specifically, the BET lamps 17*a* to 17*c* are caused to turn on based on the number of medals bet on the game. Also, the number of credited medals, the number of payout medals when a combination is realized and the like are displayed in the credit display part 19. In step S155, the registers are restored to end the periodic interrupt processing.

The reset interrupt processing by the sub-CPU (image control microcomputer 81) will be described with reference to FIG. 34.

The image control microcomputer 81 is constituted so that power is first turned on and a reset interrupt is caused by applying a voltage to the reset terminals. Then, based on generation of the interrupt, "reset interrupt processing by the sub-CPU" stored in the program ROM 83 is sequentially performed.

First, the image control microcomputer 81 initializes the work RAM 84, control RAM 87, video RAM 89 and the like (step S161), and then the flow proceeds to step S162. In step S162, command reception processing described later with reference to 35 is performed, then the flow proceeds to step S163. In the command reception processing, symbol data by the LEDs 100*a*, speakers 9L and 9R, liquid crystal display 131, lamps 100*b* and the like is determined in accordance with the type and information of the received command. In step S163, command (command in accordance with the determined symbol data to each control circuit such as the LEDs 100*a*) output processing for outputting a command to the sound/lamp control circuit (m Sub) 72*b* is carried out, then the flow proceeds to step S161.

Figure 35:
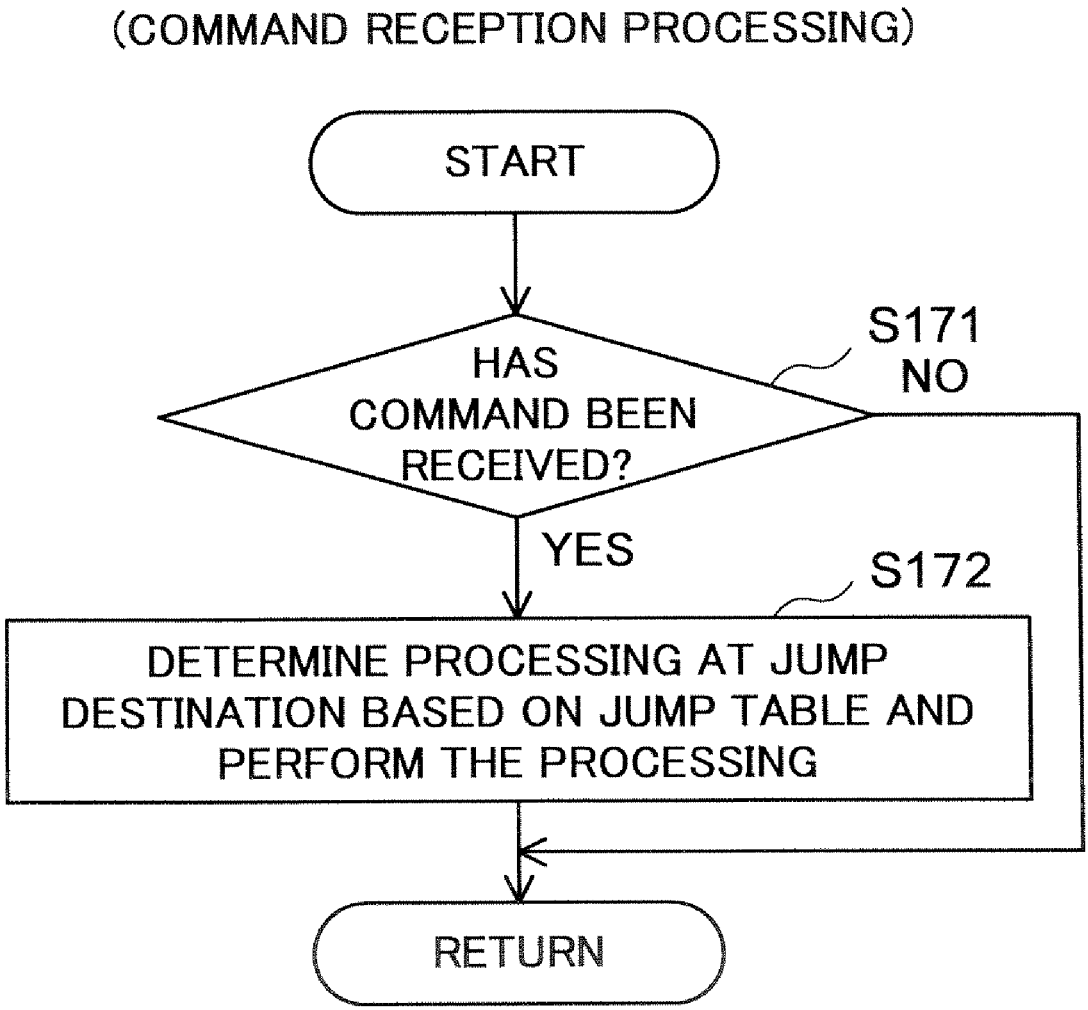
FIG. 35 is a flow chart showing the command reception processing.

The command reception processing will be described with reference to FIG. 35.

Figure 36:
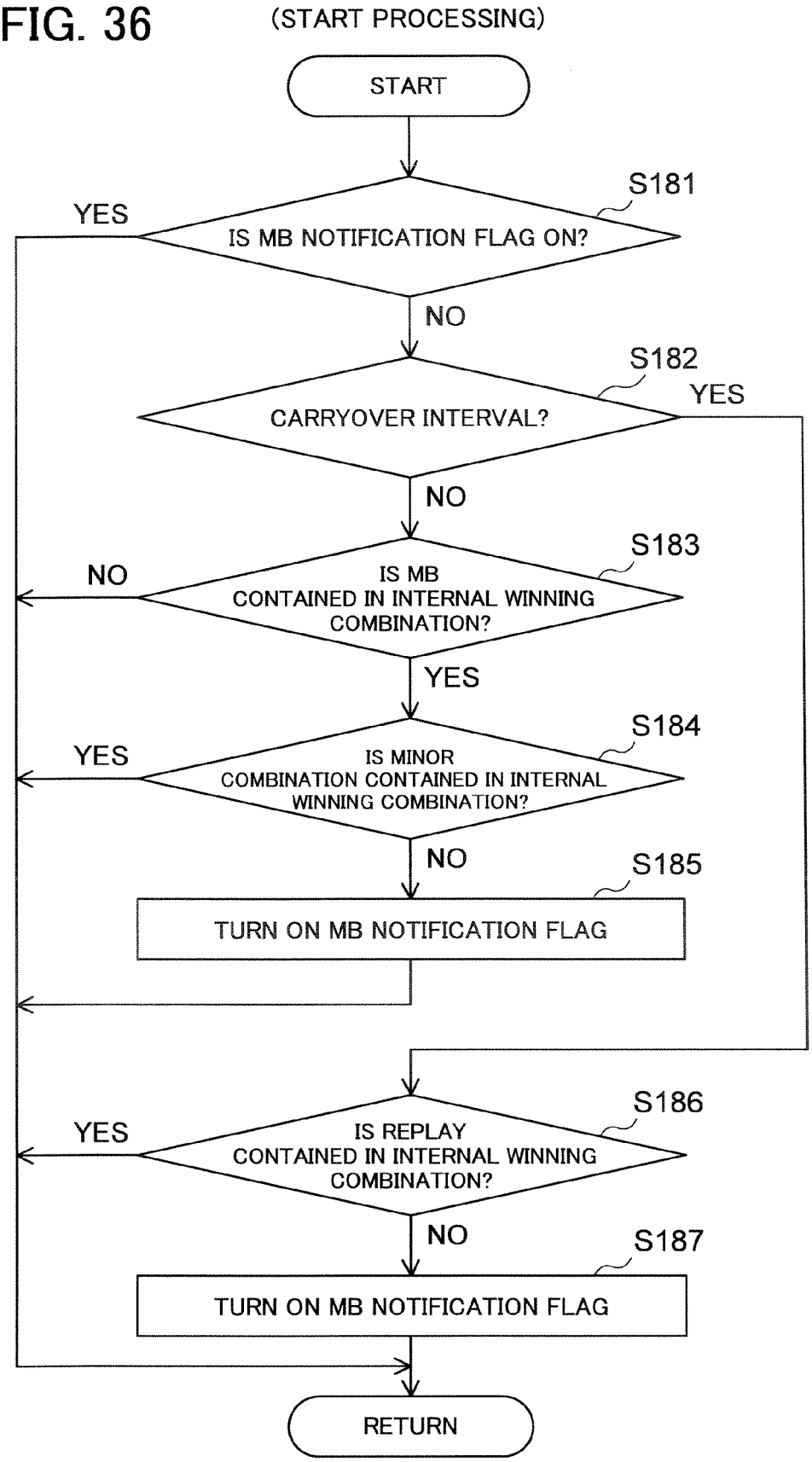
FIG. 36 is a flow chart showing the start processing.

First, the sub-control circuit 72 determines whether any command has been received (step S171). YES for this determination leads to step S172 and NO for this determination leads to step S163 in FIG. 33. In step S172, processing at a jump destination is determined based on a jump table and the processing is performed before, basically, proceeding to step S163 in FIG. 34. Processing at the jump destination includes start processing (FIG. 36 described later).

The start processing will be described with reference to FIG. 36. The start processing is performed when a start operation is performed.

First, the sub-control circuit 72 determines whether the MB notification flag is on (step S181). YES for this determination leads to step S163 in FIG. 34 and NO for this determination leads to step S182.

The MB notification flag is information for identifying whether to notify the player that MB has been won in a carryover interval. Conditions for updating the MB notification flag to on are that only MB is internally won in a normal interval, that is, MB is not internally won together with a minor combination and a combination other than Replay is internally won for the first time after starting a carryover interval. A condition for updating the MB notification flag to off is that a carryover interval ends.

In step S182, whether or not a carryover interval occurs is determined. YES for this determination leads to step S186 and NO for this determination leads to step S183. In step S183, whether an MB is contained in the internal symbol combination is determined. YES for this determination leads to step S184 and NO for this determination leads to step S163 in FIG. 34. In step S184, whether a minor combination is contained in the internal symbol combination is determined. YES for this determination leads to step S163 in FIG. 34 and NO for this determination leads to step S185.

Figure 34:
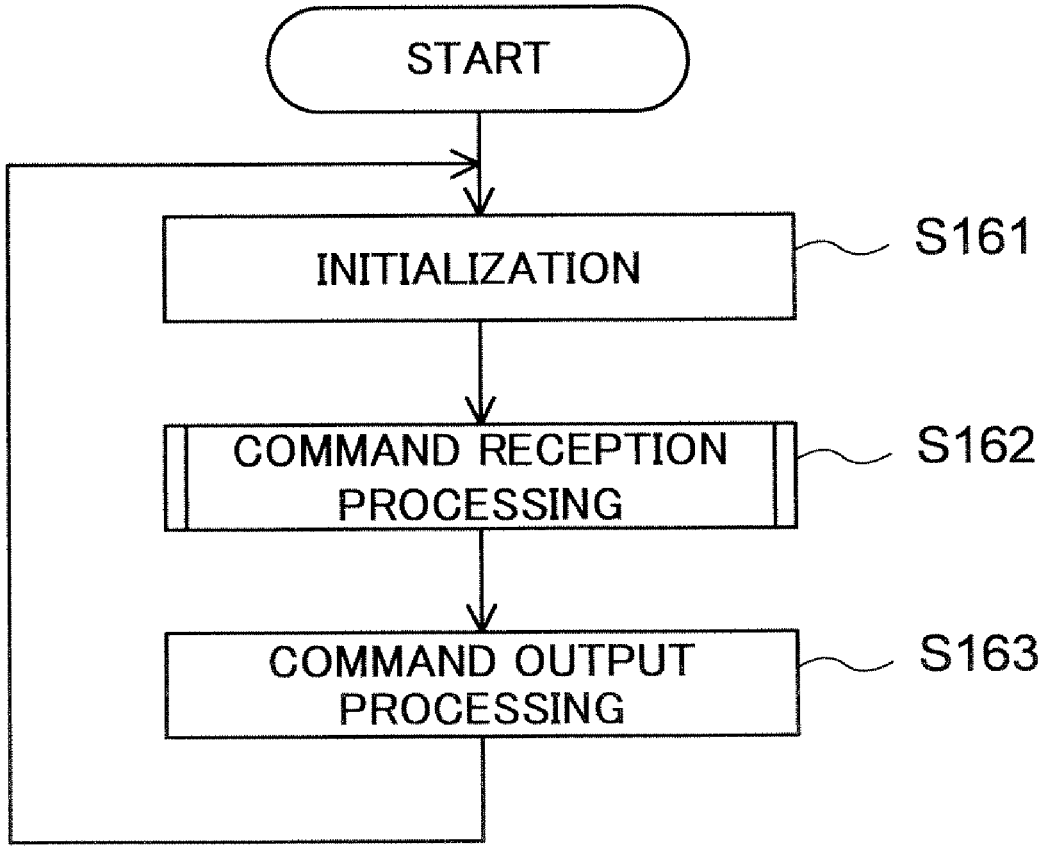
FIG. 34 is a flow chart showing the reset interrupt processing by sub-CPU.

In step S185, the MB notification flag is updated to on, then the flow proceeds to step S163 in FIG. 34. If the MB notification flag is updated to on, information shown in FIG. 10 is signaled until the current carryover interval ends. In step S186, whether Replay is contained in the internal symbol combination is determined. YES for this determination leads to step S163 in FIG. 34 and NO for this determination leads to step S187. In step S187, the MB notification flag is updated to on, then the flow proceeds to step S163 in FIG. 34.

In the present embodiment, "Red 7" and "Don-chan" are selected as symbol members on each of the reels 3L, 3C, and 3R, but the present invention is not limited to this and symbol members may be used for all symbols to drive them to slide. By enabling all symbol members to be driven to slide, symbol members can be moved sliding not only when certain symbols appear, but also when expectations are raised due, for example, to appearance of a combination of symbols just before winning.

Symbol members may also be allowed to rotate while they are made to project from the surface of each of the reels 3L, 3C, and 3R. This can help with "sharpshooting" so that even a novice can enjoy game playing. Furthermore, symbol members may be constituted so that, after causing the symbol members to project from the surface of each of the reels 3L, 3C, and 3R, they are rotated or the like. This can help to give more surprises to the player with a presentation other than sliding, even in a gaming machine with not much room available for the sliding distance.

So far, an embodiment according to the present invention has been described, but the present invention is not limited to this embodiment. For example, in addition to the pachislot machine of the present embodiment, the present invention can also be applied to other gaming machines such as slot machines.

Figure 37:
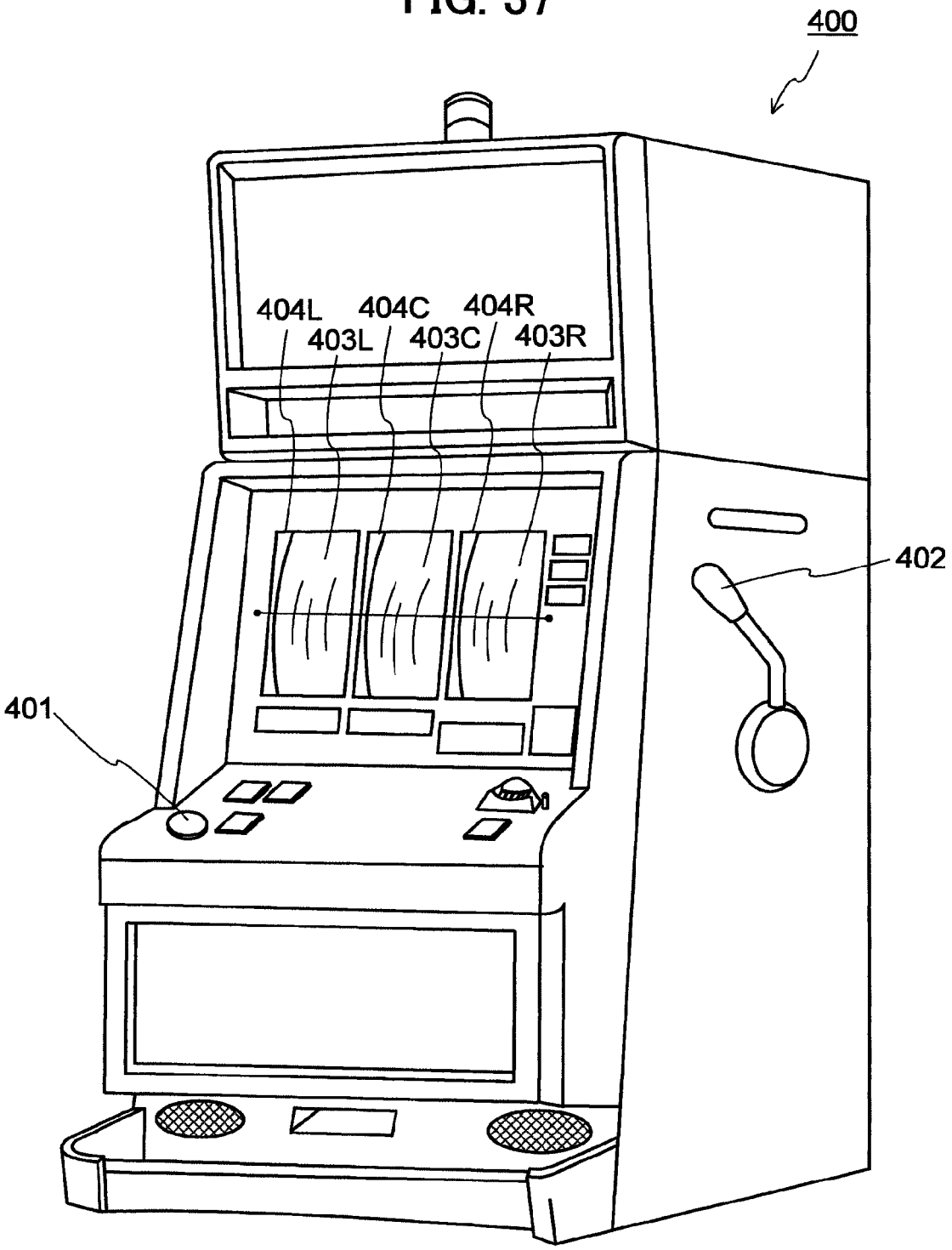
FIG. 37 is a perspective view showing the appearance of a slot machine.

Here, FIG. 37 shows a perspective view of an appearance of a slot machine 400. In the case of the slot machine 400, when a player performs an operation of a start button 401 (start switch) or an operation lever 402, this establishes a game condition. A control device (not shown) drives reels 403L, 403C, and 403R of a symbol variable device (not shown) to rotate and, at the same time, samples a random number to determine whether the sampled value corresponds to a winning combination by referencing a predetermined table. Then, based on this determination result, the control device determines the symbols to be presented in display windows 404L, 404C, and 404R when the reels stop and, after a predetermined time passes, performs a control operation to stop rotation of the reels 403L, 403C, and 403R to grant a play value to the player. In this way, the present invention can also be applied to a controlled slot machine 400. The control to stop the reels is not limited to the passage of a predetermined time, as described above and, instead, a condition of a play value such as the number of coins or the like may be imposed. Also, these may be changed at appropriate times.

According to the present invention, as described above, first, by using three-dimensional symbols (for example, the symbols members 191 and 192) having moving device (for example, the actuators 304L, 304C, and 304R) that can appear from the outer circumferential surface of reels to the outside of the reel surface in parts of the reel symbols and causing these three-dimensional symbols to project in a direction perpendicular to the outer circumferential surface of the reels using the moving device, it becomes possible for the three-dimensional symbols to appear from the outer circumferential surface of the reels or more out and back. This makes it possible, for example, to add visual representations to reel symbols and the player can enjoy playing games while perceiving surprises and fun in the behavior of such three-dimensional symbols.

By linking such visual representations using three-dimensional symbols with other representations such as liquid crystal displays (for example, the liquid crystal display 131), indication lamps (for example, the LEDs 100*a* and lamps 100*b*), and speech output devices (for example, the speakers 9L and 9R), more still fun can be provided.

Furthermore, if reels are caused to rotate while three-dimensional symbols are projected from the reels, visibility of symbols is improved and, for example, "sharpshooting" can be helped so that even a novice can have more fun playing the game.

Also, second, by providing a light source, that is, a luminescent device such as an LED inside a three-dimensional symbol, in addition to a projecting operation of the three-dimensional symbol, representation by light can also be added, further increasing the degree of an attention to symbols. This makes it possible for a player to enjoy unconventional surprises and fun because the player can play games while visually recognizing changes in the color of symbols changing in a variety of ways.

Moreover, third, since a player can, for example, play games while visually recognizing changes of three-dimensional symbols and the like changing in a variety of ways by providing a slewing gear (for example) in a reel that causes three-dimensional symbols to rotate, the player can play games while perceiving unconventional surprises and fun.

Furthermore, fourth, if used in a slot machine, game playing results by reels are presented on a larger scale than other gaming machines such as a pinball gaming machine and thus games can be played while perceiving representations with more visual impact. Therefore, the player can, for example, enjoy playing games while perceiving unconventional surprises and fun, further increasing interest in the game.

What is claimed is:

1. A gaming machine comprising:

a plurality of reels rotatably provided with a plurality of types of symbols on a peripheral face;

a plurality of three-dimensional members disposed inside said peripheral face of said reels, each of which is capable of appearing from said peripheral face of each reel; and a plurality of moving device, each of which make said each three-dimensional member freely appear from said peripheral face to an outside and disappear; wherein each of said symbols includes a plurality of planar symbols on the peripheral face of each reel and a plurality of three-dimensional symbols on a surface of each three-dimensional member and said moving device cause said three-dimensional members to project from said peripheral face to the outside if said reels stop and said symbols displayed in a predetermined area include any of said three-dimensional symbols.

2. The gaming machine according to claim 1, wherein each of said reels comprises a plurality of light sources disposed inside each three-dimensional member.

3. The gaming machine according to claim 1, wherein each of said reels is connected to each three-dimensional member and comprises a plurality of slewing gears that cause each three-dimensional member to rotate around an axis in a direction perpendicular to said peripheral face.

4. The gaming machine according to claim 1, wherein three of said reels arrange side by side, and said gaming machine being a slot machine.

5. The gaming machine according to claim 1, wherein each of said moving devices is elastically connected to each three-dimensional member, symbol holes formed in shapes similar to symbols corresponding to said three-dimensional symbols and formed to allow said three-dimensional members to slide are provided on the peripheral face of said reels, and each three-dimensional member appears in a direction perpendicular to the peripheral face from said symbol holes of said peripheral face by expansion and contraction of each moving devices.

6. The gaming machine according to claim 1, further comprising an image display device displaying images related to a game is provided in front of said reels.

* * * * *